US010273780B2

(12) United States Patent
Garcia et al.

(10) Patent No.: US 10,273,780 B2
(45) Date of Patent: Apr. 30, 2019

(54) HYDRAULICALLY ACTUATED TOOL WITH PRESSURE ISOLATOR

(71) Applicant: PACKERS PLUS ENERGY SERVICES INC., Calgary (CA)

(72) Inventors: Albert Garcia, Azle, TX (US); Andrew Peter Quinlan, Houston, TX (US); John Lee Emerson, Katy, TX (US); Fernando Olguin, Houston, TX (US); Gustavo Mendoza, Houston, TX (US); Patrick Glen Maguire, Cypress, TX (US); Christopher Denis Desranleau, Sherwood Park (CA); Ryan Fredrick Addy, Leduc (CA); Matthew John Skinner, Edmonton (CA)

( * ) Notice: Subject to any disclaimer, the term of this patent is extended or adjusted under 35 U.S.C. 154(b) by 85 days.

(21) Appl. No.: 15/022,490

(22) PCT Filed: Sep. 18, 2014

(86) PCT No.: PCT/CA2014/050898
§ 371 (c)(1),
(2) Date: Mar. 16, 2016

(87) PCT Pub. No.: WO2015/039248
PCT Pub. Date: Mar. 26, 2015

(65) Prior Publication Data

US 2016/0230505 A1 Aug. 11, 2016

Related U.S. Application Data

(60) Provisional application No. 62/011,717, filed on Jun. 13, 2014, provisional application No. 61/887,822,
(Continued)

(51) Int. Cl.
*E21B 34/10* (2006.01)
*E21B 23/00* (2006.01)
(Continued)

(52) U.S. Cl.
CPC ..... *E21B 34/10* (2013.01); *E21B 23/006* (2013.01); *E21B 23/01* (2013.01); *E21B 33/12* (2013.01);
(Continued)

(58) Field of Classification Search
CPC ..... E21B 34/10; E21B 23/01; E21B 47/12; E21B 33/12; E21B 41/00; E21B 23/006; E21B 34/06; E21B 2034/007
See application file for complete search history.

(56) References Cited

U.S. PATENT DOCUMENTS 5,343,963 A 9/1994 Bouldin et al.
5,558,153 A 9/1996 Holcombe et al.
(Continued)

FOREIGN PATENT DOCUMENTS

CA 2735402 C 10/2011
WO 2009098512 A2 8/2009
(Continued)

*Primary Examiner* — Brad Harcourt

(57) ABSTRACT

A wellbore tool that can withstand pressure tests without becoming hydraulically actuated. The wellbore tool includes a tubular housing including an inner bore; a tool mechanism responsive to fluid pressure; and a pressure isolator for the tool mechanism moveable between an active and an inactive position.

43 Claims, 14 Drawing Sheets

Related U.S. Application Data filed on Oct. 7, 2013, provisional application No. 61/879,998, filed on Sep. 19, 2013, provisional application No. 61/879,546, filed on Sep. 18, 2013.

(51) Int. Cl.

| | |
|---|---|
| ***E21B 34/06*** | (2006.01) |
| ***E21B 41/00*** | (2006.01) |
| ***E21B 23/01*** | (2006.01) |
| ***E21B 33/12*** | (2006.01) |
| ***E21B 47/12*** | (2012.01) |
| *E21B 34/00* | (2006.01) |

(52) U.S. Cl.

CPC ..... *E21B 34/06* (2013.01); *E21B 41/00* (2013.01); *E21B 47/12* (2013.01); *E21B 2034/007* (2013.01)

(56) References Cited

U.S. PATENT DOCUMENTS

| | | | | |
|---|---|---|---|---|
| 5,579,283 | A | 11/1996 | Owens et al. | |
| 6,021,095 | A | 2/2000 | Tubel et al. | |
| 6,414,905 | B1 | 7/2002 | Owens et al. | |
| 6,443,228 | B1 | 9/2002 | Aronstam et al. | |
| 7,237,616 | B2 * | 7/2007 | Patel | E21B 23/00 166/381 |
| 8,102,276 | B2 | 1/2012 | Sugiura | |
| 8,757,273 | B2 | 6/2014 | Themig et al. | |
| 2001/0042617 | A1 | 11/2001 | Beck et al. | |
| 2007/0272411 | A1 | 11/2007 | Lopez de Cardenas et al. | |
| 2008/0264633 | A1 | 10/2008 | Hudson | |
| 2009/0272544 | A1 | 11/2009 | Giroux et al. | |
| 2011/0056692 | A1 | 3/2011 | Lopez de Cardenas et al. | |
| 2011/0168403 | A1 | 7/2011 | Patel | |
| 2011/0232917 | A1 | 9/2011 | Skinner et al. | |
| 2011/0240301 | A1 | 10/2011 | Robison et al. | |
| 2011/0308784 | A1 | 12/2011 | Ollenrenshaw et al. | |
| 2012/0037360 | A1 | 2/2012 | Arizmendi, Jr. et al. | |
| 2012/0261136 | A1 | 10/2012 | Ehtesham et al. | |
| 2013/0043048 | A1 | 2/2013 | Joseph | |
| 2013/0264051 | A1 * | 10/2013 | Kyle | E21B 41/00 166/244.1 |
| 2013/0284432 | A1 * | 10/2013 | MacPhail | E21B 47/14 166/250.01 |
| 2014/0251619 | A1 * | 9/2014 | George | E21B 34/063 166/305.1 |

FOREIGN PATENT DOCUMENTS

| | | | |
|---|---|---|---|
| WO | 2011146866 | A2 | 11/2011 |
| WO | 2012045165 | A1 | 4/2012 |
| WO | 2013131194 | A1 | 9/2013 |
| WO | 2013170372 | A1 | 11/2013 |

* cited by examiner

HYDRAULICALLY ACTUATED TOOL WITH PRESSURE ISOLATOR

PRIORITY APPLICATION

This application claims priority from U.S. provisional patent applications: No. 62/011,717, filed Jun. 13, 2014; No. 61/887,822, filed Oct. 7, 2013; No. 61/879,998, filed Sep. 19, 2013; and No. 61/879,546, filed Sep. 18, 2013.

FIELD OF THE INVENTION

The invention relates to tools, systems and methods for pressure testing and actuating a wellbore tool, in particular, a hydraulically actuated tool.

BACKGROUND OF THE INVENTION

Hydraulically actuated tools include mechanisms that are driven by hydraulic pressure. Mechanisms can include burst inserts, sleeves, pistons, etc.

In wellbore operations, one or more hydraulically actuated tools may be installed in a wellbore, for example, as a component in a wellbore string. Pressures communicated through the wellbore, for example, through the string may be used to actuate the tool's mechanism.

There is a risk that the mechanism of a hydraulically actuated tool could be actuated prematurely if there is a pressure spike in the wellbore. In particular, if there is a need to pressure test the wellbore, the mechanism could prematurely function due to the test pressures.

SUMMARY OF THE INVENTION

In accordance with an aspect of the present invention, there is provided a method for actuating a downhole tool, the method comprising: conducting a pressure test in a tubing string by raising the tubing pressure to a test pressure; preventing the test pressure from hydraulically actuating the downhole tool during the pressure test by operation of a pressure isolator for the downhole tool; inactivating the pressure isolator to permit hydraulic actuation of the downhole tool; and employing fluid pressure to hydraulically actuate the downhole tool.

In accordance with another aspect of the present invention, there is provided a wellbore tool comprising: a tubular housing including an upper end, a lower end and a wall defined between an inner surface and an outer surface, the inner surface defining an inner bore; a tool mechanism responsive to tubing fluid pressure; and a pressure isolator configurable between an active condition and an inactive condition, the pressure isolator in the active condition preventing the tool mechanism from being actuated by tubing fluid pressure and the pressure isolator in the inactive condition, permitting actuation of the tool mechanism by tubing fluid pressure.

For example, there is provided a wellbore tool comprising: a tubular housing including an upper end, a lower end and a wall defined between an inner surface and an outer surface, the inner surface defining an inner bore; a port closure responsive to fluid pressure; and a pressure isolator including a releasable locking member to releasably lock the port closure in a configuration preventing tubing pressure from actuating the tool mechanism and a pressure responsive portion configured (i) to sense a pressured up condition in the inner bore and (ii) to cause the releasable locking member to move into an inactive, unlocked position in response to the pressured up condition.

For example, there is also provided a wellbore tool comprising: a tubular housing having an upper end, a lower end, an outer surface, and an inner surface defining an inner bore; a tool mechanism responsive to fluid pressure; a pressure isolator positioned between the tool mechanism and the inner bore in a position sealing fluid from passing from the inner bore into actuable contact with the tool mechanism; and downhole equipment in communication with the pressure isolator, the pressure isolator being inactivated after the downhole equipment receives an output signal to permit fluid to pass from the inner bore into actuable contact with the tool mechanism.

For example, in accordance with another broad aspect of the present invention, there is provided a wellbore tool comprising: a tubular housing including an upper end, a lower end and a wall defined between an inner surface and an outer surface, the inner surface defining an inner bore; a tool mechanism responsive to fluid pressure; and a pressure isolator positioned between the tool mechanism and the inner bore, the pressure isolator including a retention member to releasably retain the pressure isolator in a position sealing fluid from passing from the inner bore into actuable contact with the tool mechanism and the retention member being releasable after receiving a signal.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1A:
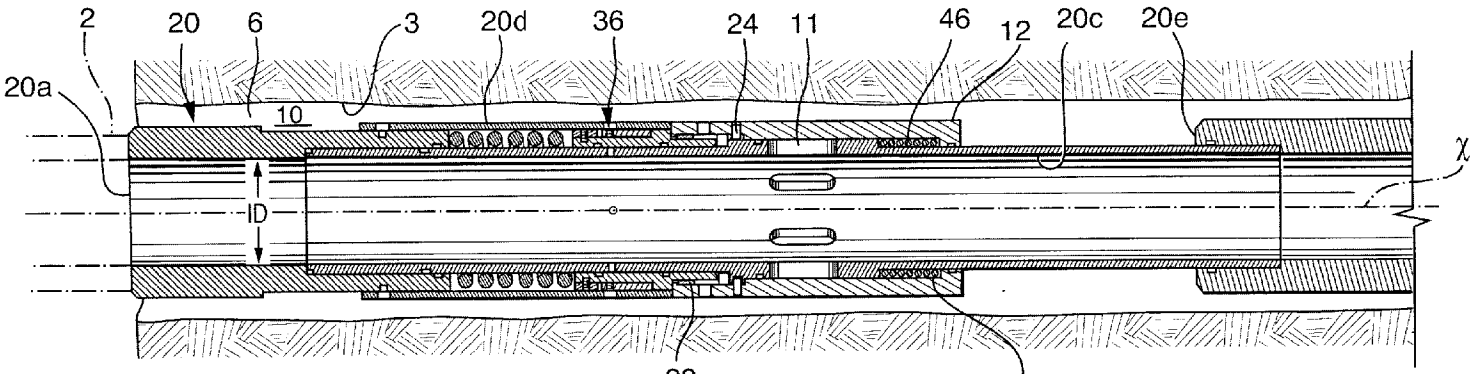
FIG. 1A is a sectional view through a wellbore tool in a run-in hole (RIH) position.
Figure 1C:
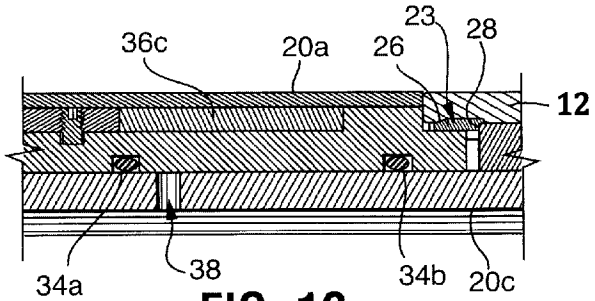
FIG. 1C is an enlarged view of a portion of FIG. 1B.
Figure 1B:
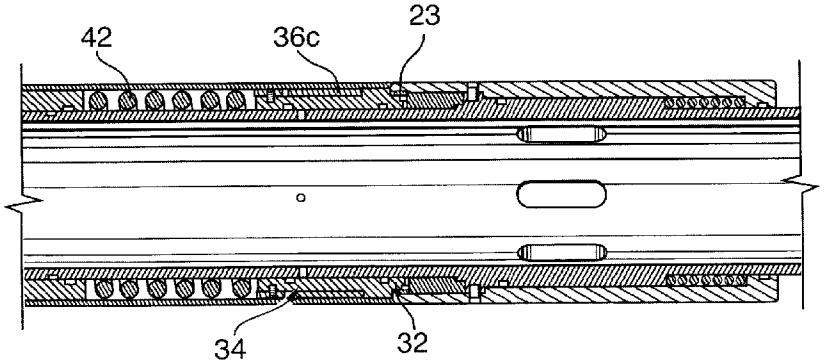
FIG. 1B is an enlarged view of a axial section through the wellbore tool of FIG. 1A, but rotated slightly (not passing through a port 11)

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A hydraulically actuated wellbore tool may include a tool mechanism responsive to fluid pressure. The tool mechanism of the present tool is responsive to fluid pressure communicated through the inner bore of the tool, which is in communication with a tubing string bore (commonly called tubing pressure). The present tool also includes a pressure isolator for the tool mechanism. The pressure isolator has an active condition, in which it prevents tubing pressure from actuating the tool mechanism, and an inactive condition, in which tubing pressure, if sufficient, can actuate the tool mechanism.

In some embodiments, the pressure isolator includes a plug, which in the active condition is positioned between the tool mechanism and the tubing string inner bore so that actuating tubing pressure cannot be communicated to the tool mechanism until the pressure actuator is inactivated. The plug, for example, may seal fluid from passing from the tool inner bore into actuable contact with the tool mechanism.

In other embodiments, the tubing pressure is not blocked by the pressure isolator from communication to the tool mechanism, but rather the tool mechanism is prevented, for example secured, from being actuated by tubing pressure. In such an embodiment, only once the pressure isolator is inactivated is the tool mechanism free to actually be actuated by the tubing pressure.

In some embodiments, the pressure isolator includes a releasable lock to releasably lock against actuation of the tool mechanism. For example, the releasable lock can releasably lock the pressure blocking plug in a position sealing fluid from passing from the inner bore into actuable contact with the tool mechanism. In another embodiment, the releasable lock can lock the tool mechanism against pressure actuation.

The releasable lock can be releasable after receiving a signal.

In operation, the tool may be employed in a wellbore operation wherein the tool is positioned in a well and the pressure isolator remains in the active condition until it is inactivated and only then can tubing pressure (i.e. the pressure within the tubing string and the tool) actuate the tool's hydraulically actuated mechanism.

However, while the pressure isolator is in the active condition, the tool's hydraulically actuated mechanism cannot be actuated by tubing pressure (i.e. is isolated from tubing pressure or is locked against actuation by tubing pressure). Thus, tubing pressure can be raised close to and, in fact, well above any actuating pressure level for the tool's hydraulically actuated mechanism without risk of actuating it. Thus, while the pressure isolator is in the active condition, pressure tests can be conducted, for example, to ensure tubing string pressure integrity.

Figure 6:
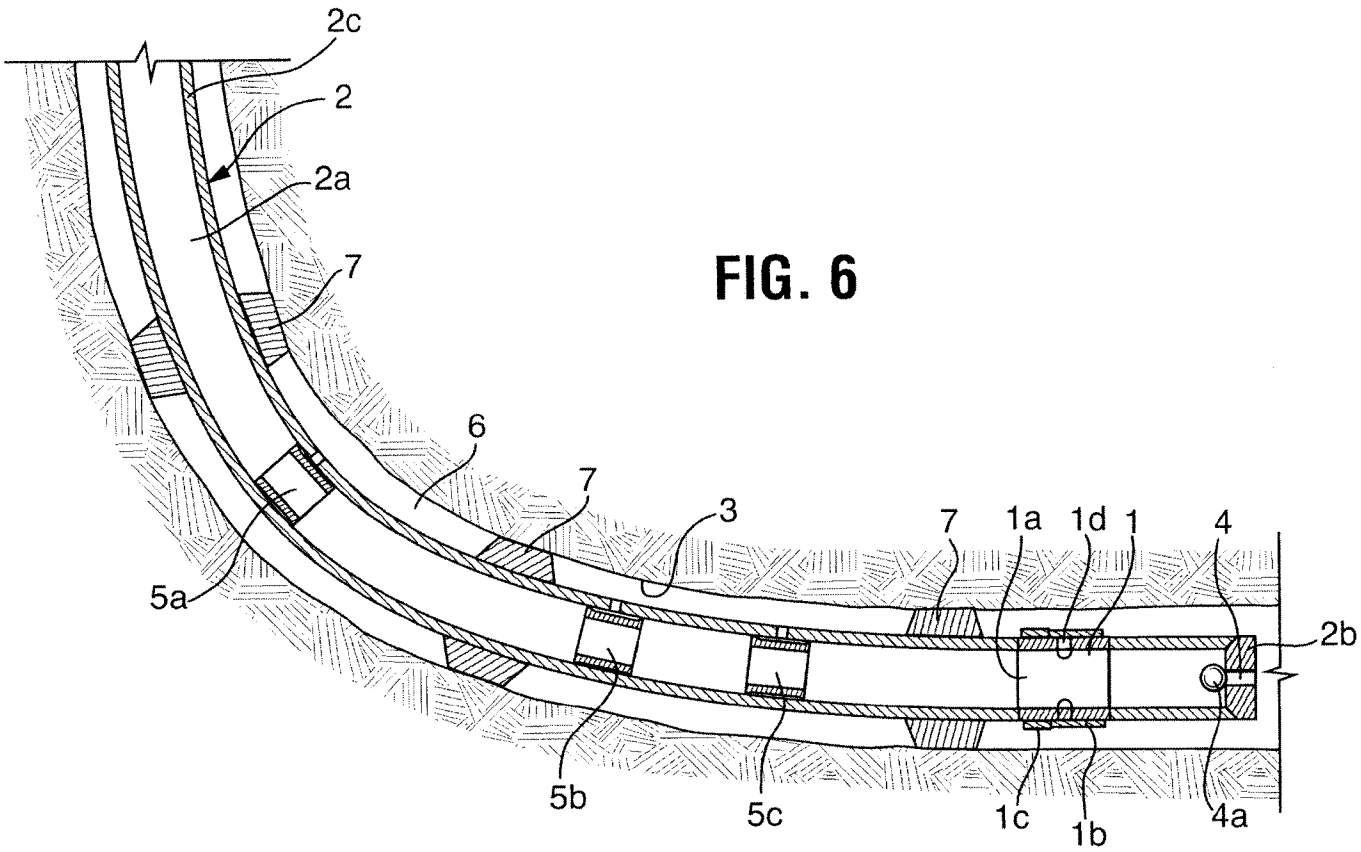
FIG. 6 is a schematic view of a wellbore string in a well.

With reference to FIG. 6, a hydraulically actuated wellbore tool 1 is shown. Tool 1 includes a housing defining an inner bore 1*a*; a tool mechanism 1*b* responsive to tubing fluid pressure from the inner bore; and a pressure isolator mechanism 1*c* actuatable between an active condition and an inactive condition, the pressure isolator mechanism is installed for the tool mechanism to ensure that while it is in the active condition the tool mechanism cannot be actuated by tubing fluid pressure and when the pressure isolator mechanism is in the inactive condition, the tool mechanism can be actuated by tubing fluid pressure. As noted, the pressure isolator mechanism, when in the active condition, may block tubing pressure from being communicated to the tool mechanism or may hold the tool mechanism against actuation. When the pressure isolator mechanism is appropriately signaled, it reconfigures from the active condition to the inactive condition. The pressure isolator mechanism may include a releasable lock and when signaled the lock is released. In some embodiments, the signal can be a pressure pulse, where pressure is increased and then dissipated. In one embodiment, the pressure pulse is generated during the pressure test.

In operation, the tool may be employed in a wellbore operation wherein the tool is installed in a tubing string 2 and positioned in a well defined by wellbore wall 3 with the housing in a selected position. The pressure isolator mechanism 1*c* remains in the active condition so that tubing pressure (i.e. the pressure within the tubing string bore 2*a* and within inner bore 1*a* of the tool) cannot actuate the tool's hydraulically actuated tool mechanism 1*b*. Thus, tubing pressure can be raised well above any actuating level of mechanism 1*b* without risk of actuating the tool's hydraulically actuated mechanism 1*b*. This permits pressure tests to be conducted which may elevate the tubing pressure to or well above the actuating pressure for tool mechanism 1*b*. This may be conducted, for example, to ensure tubing string pressure integrity. With the pressure isolator active, the tool mechanism 1*b* is protected against inadvertent actuation by the test pressure.

Generally, a wellbore tool often has a tubular housing, which, having a tubular form, can pass readily through the wellbore as drilled. Also, tubular forms can be connected by threading into assembled tools or strings deployable into a well. The tool may be run with the tubing string into a well for temporary use or may be installed in a well for longer term use or reuse.

The wellbore tool may be a packer, an anchor, a ported tool, etc. The form of the wellbore tool is determined by its tool mechanism. For example, a packer includes a tool mechanism including a packing mechanism with at least a set and an unset position, the packing mechanism may include an annular packing element, one or more compression rings, etc. The tool mechanism of an anchor includes an anchoring mechanism including at least a set and an unset position, the anchoring mechanism may include a plurality of slips, a slip expander, etc. A ported tool is intended for fluid circulation between the inner bore 1*a* and the outer surface of the tool. A ported tool includes a port and the tool mechanism includes a closure for the port configurable to open and close the port. Thus, a ported tool has at least a closed port position and an open port position. The closure may be a burst plug, a sliding sleeve, a pocket plug, etc.

The form of the tool determines the method that is carried out by the tool. For example, the method may include forming an annular seal, anchoring a tool, opening a port, etc.

In the illustrated embodiment, tool 1 is intended to function primarily as a ported tool. The tool has a port 1*d* which is openable by actuation of a closure to provide access between the tubing string inner diameter 2*a*, including the tool inner bore 1*a*, and the tubing string outer surface, which in use is in the annular area 6 between the tubing string and the wellbore wall 3. The tool mechanism 1*b* is an actuating mechanism for opening the port, for example, removing the closure.

The tool, as shown here, is pressure testable to permit string pressure integrity to be tested before actuating the mechanism to open the ports of the tool. The tool is capable of withstanding one or more pressure tests without concern of the port closure being opened during the pressure test. In particular, if the closure is a sleeve or piston or if the closure is a burst disk, the shear screw or burst disk, "high/low" holding tolerances are not of consequence to the pressure test. In particular, the pressure holding tolerances of the closure may be below the pressures achieved during the pressure test.

The purpose of the tool may depend on its position in the well. For example, the tool may be useful as a toe sub, which is a tool installed adjacent the distal end 2*b*, or toe, of the tubing string. The toe sub may be used to create fluid conductivity to the annulus 6 and/or for fluid treatment. If the tool is positioned closer to surface, it may not be considered a toe port tool, but rather a fluid treatment tool. It may be employed, for example, alone or in series with other tools along the length of the tubing string.

For example, as illustrated here, the toe sub 1 may be positioned close to toe 2*b*. The string also includes a circulation sub 4 between toe sub 1 and toe 2*b*. In addition, a plurality of fluid treatment ported tools 5*a*, 5*b*, 5*c* are positioned between the toe sub 1 and the upper end 2*c*.

The circulation sub 4 may be intended to be open during run in of the tubing string while other ports such as those of toe sub 1 and fluid treatment tools 5*a*-5*c* are closed. As such, during run in fluids may be circulated between the tubing string bore 2*a* and annular area 6 between the string and the wellbore wall. Generally, the circulation will be down through the tubing string and up through the annular area.

When the string is in place and tubing string hydraulic operations are to begin, the circulation valve of the circulation sub is closed to stop flow to the annulus 6. In one embodiment, such as that illustrated, circulation sub 4 includes a sleeve valve to control the open and closed condition of its ports. The sleeve valve includes a seat protruding into the inner bore of the tubing string. The sleeve valve is closed by dropping a ball 4*a* to land in a seat of sub 4 and a pressure differential is established above and below the seat to close the port of the circulation sub.

As such, at that time, the tubing string is closed with all of the ports of circulation sub 4, toe sub 1 and fluid treatment tools 5*a*-5*c* closed.

If desired, packers 7 can be set to secure the tubing string in the well and to control circulation through the annulus 6. Alternately or in addition, cement may be pumped into the annulus 6 (not shown in this embodiment). If cementing is additional to packers a stage tool may be employed.

When the tubing string tool ports are closed and the string is secured in the well, a tubing string integrity pressure test can then be conducted to ensure that the tubing can hold pressure up to a selected value. In one embodiment, for example, the tubing string is pressured up to a pressure below the activating pressure of the hydraulically actuated tools in the string, or in other embodiments, for example, the pressure test may be intended to test tubing integrity at fracing pressures well above the activating pressure of the hydraulically activated tools in the string.

The pressure test may include one or more pressure up conditions, as determined by the well operator.

While tools within the string, including the toe sub 1, may include hydraulically actuated mechansims, they must be protected against actuating during the pressure tests. In fact, even after the pressure tests are conducted, the operator may wish the tools to remain unactuated for an additional period such as of hours, days, weeks, months or perhaps even years.

Thus, some time after the pressure tests are conducted, the ports are to be opened. Generally, the first port to be opened is that of the toe sub 1. In particular, opening of the toe sub permits conductivity to the formation so that other pumping operations to the tubing string can commence, such as the opening of ports 5*a*-5*c* and the pumping operations, such as fracing operations, therethrough.

The tools and methods of the present invention can be used in various borehole conditions including open holes, cased holes, cemented holes, vertical holes, horizontal holes, straight holes or deviated holes.

With reference to the FIGS. 1A to 5C, there is shown a tool 10 intended to function primarily as a ported tool, for example, a toe sub. The tool has a port 11 which is openable to provide access between the tubing string inner diameter and the tubing string outer surface, which in use is in the annular area 6 between the tubing string and the wellbore wall 3.

The tool, as shown here, is pressure testable to permit casing pressure integrity to be tested before opening the tool. The tool is capable of withstanding a pressure test without concern of the port closure being opened during the pressure test. In particular, if the closure is a sleeve or piston or if the closure is a burst disk, the shear screw or burst disk "high/low" holding tolerances are not of consequence to the pressure test. In particular, the pressure holding tolerances of the closure may be below the pressures achieved during the pressure test.

The purpose of the tool may depend on its position in the well. For example, the tool may be useful as a toe port tool, also called a toe sub, which is a tool installed adjacent the distal end, or toe, of the tubing string. The toe port tool may be used to create fluid conductivity to the annulus 6 and/or for fluid treatment. If the tool is positioned closer to surface, it may not be considered a toe port tool, but rather a fluid treatment tool. It may be employed, for example, alone or in series along a length of the tubing string. The tools may have the same structure regardless of whether they are used as a toe port or a fluid treatment tool, its operation being dependent on its position in the well and the closure mechanism used to open the port.

The tool includes a tubular housing 20 including an upper end 20*a*, a lower end 20*b*, an inner surface 20*c* defining an inner diameter ID and an outer surface 20*d*. Although not shown, the sliding sleeve tool, is formed as a sub with its tubular housing 20 having ends 20*a*, 20*b* threaded or otherwise formed such that it may be connected into a wellbore tubular string. The housing defines a long axis x extending concentrically relative to inner surface 20*c* through ends 20*a*, 20*b*.

Figure 5A:
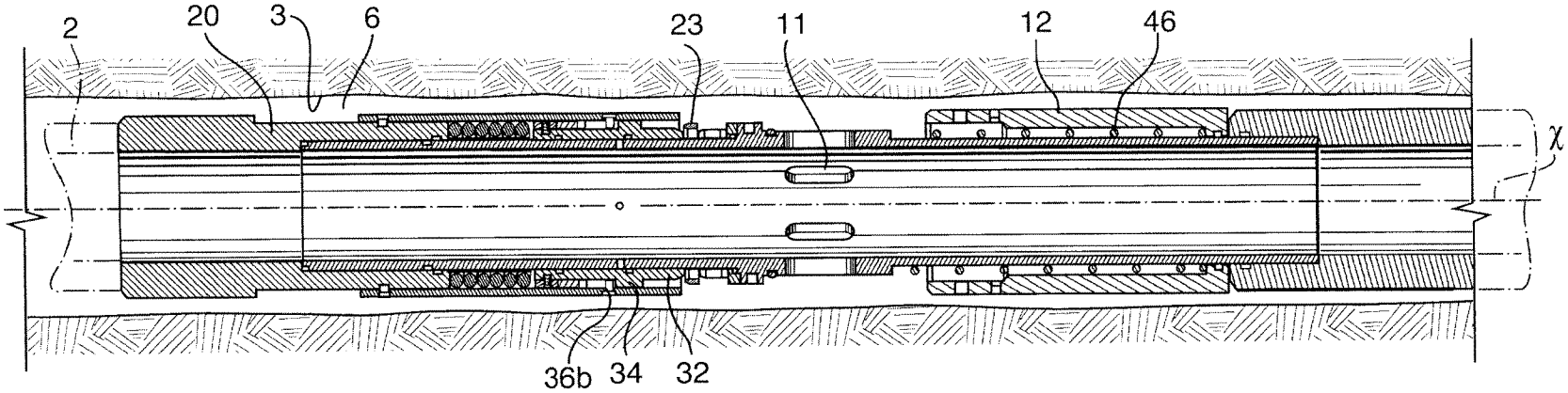
FIG. 5A is a sectional view through a wellbore tool in a port-open position.
Figure 5C:
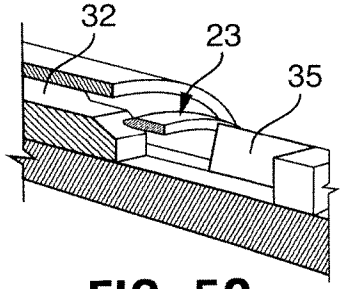
FIG. 5C is an enlarged view of a portion of FIG. 5B.
Figure 5B:
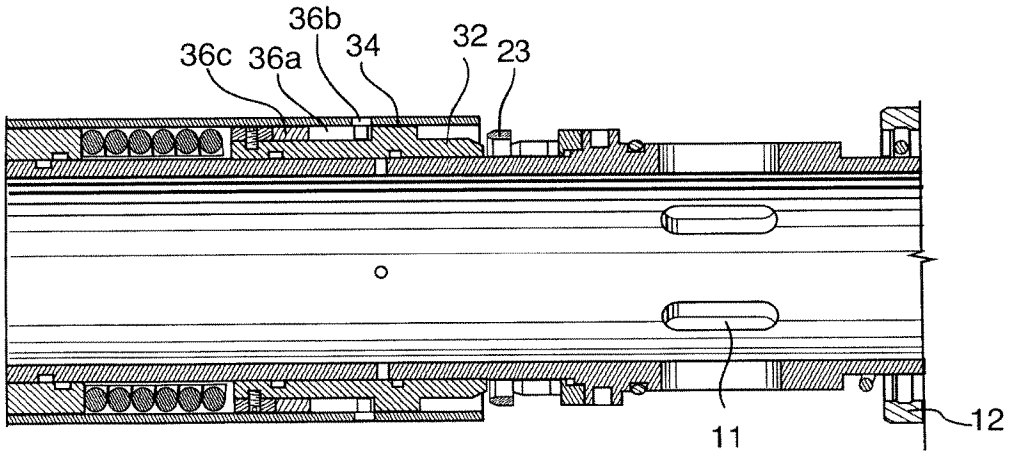
FIG. 5B is an enlarged view of a portion of FIG. 5A.

Tool 10 includes a port 11 through the wall thereof that, when open, provides fluid access from the inner diameter ID to the outer surface 20*a*. A sleeve 12 acts as a closure to control the open and closed condition of port 11. In particular, the open and closed condition of port 11 is determined by sleeve 12. The sleeve is axially moveable in the tubular housing between a port closed position, wherein sleeve blocks and closes port 11 (FIG. 1A), and a port open position, wherein sleeve 12 is at least partially retracted from, and therefore opens port 11 (FIG. 5A). In the open position in this embodiment (FIG. 5A), sleeve 12 is moved toward end wall 20*e*, such that the sleeve is closer to end wall 20*e* and is removed from an overlapping position over port 11.

In this embodiment, sleeve 12 is positioned externally of the tubular housing and a piston face 12*b* is provided on the sleeve and fluid pressure can be communicated through port 11 to face 12*b*. In some embodiments, sleeve 12 may be installed in a pocket in the wall of the tool or it may be internal positioned against the inner wall surfaces in the inner diameter ID.

Sleeve 12 is held in the blocking position by a first releasable locking member 23 and, if desired, by a second releasable locking member 24.

First releasable locking member 23 is part of a pressure isolator. First releasable locking member 23 has an active, locked position and an inactive, unlocked position. The position of first releasable locking member is controlled by a pressure responsive portion of the pressure isolator, the pressure responsive portion sensing the pressure tests and only after the pressure tests, causes the locking member 23 to move into the inactive, unlocked position.

Sleeve 12 is only able to be moved to the open port position when the pressure isolator unlocks member 23. Releasable locking member 23 may, for example, be a lock wedge ring (as shown), engaging fingers such as collet fingers, dogs etc. In the illustrated embodiment, the releasable locking member 23 is a lock ring held between a shoulder 26 on sleeve 12 and a shoulder 28 held stationary on the tool housing. In the illustrated embodiment, locking member 23 is a locking wedge ring and locks the sleeve against movement during tubing pressure integrity tests. Sleeve 12 cannot move until the lock ring member is released from its locked position against shoulder 26.

After member 23 is released, sleeve 12 can be moved to open port 11 by the force of the pressure differential developed across face 12*b* between the pressure at port 11 and the pressure external to the tool. If a releasable locking member 24 is employed, its holding strength must be overcome as well hydraulically by the pressure differential. Releasable locking member 24 may, for example, be one or more shear pins (as shown), c-rings, engaging fingers, etc. rated for their pressure holding capability, responsive to the pressures to be communicated to face 12*b* relative to external pressure. In some embodiments, the holding capability of member 24 is less than that required to release member 23 and, so, sleeve 12 automatically opens when member 23 is released. In other embodiments, the holding capability of member 24 is more than that required to release member 23 and, so, sleeve 12 remains closed after member 23 is released and the operator must raise the pressure to a higher level to finally overcome member 24 and open sleeve 12.

Pressure from inner diameter ID may be communicated to face 12*b* through port 11. However, no reasonable amount of pressure is able to move sleeve 12 until the pressure isolator is inactivated and, particularly in this embodiment, releasable locking member 23 is unlocked.

As noted, the pressure isolator controls whether or not sleeve 12 can move by hydraulic pressure. In this illustrated embodiment, as noted, the pressure isolator includes locking member 23 and the pressure responsive portion. Herein, the pressure responsive portion includes a lock support wall 32 that supports locking member 23 against shoulder 26, a piston 34 that moves support wall 32 and a restraining member 36 that controls movement of piston 34.

Piston 34 is moved by tubing pressure communicated from inner diameter ID through port 38. Piston 34 has a differential seal structure, between differential seals 34*a*, 34*b*, such that a pressure differential can be established across piston 34 between port 38 and chamber 40 and piston can move axially due to the different piston areas offered by seals 34*a*, 34*b*. Piston 34 is biased by a resisting force, such as a coil spring 42, into a neutral position but increased pressure at port 38 moves piston 34 against the bias in spring 42. In one embodiment, piston 34 moves upwardly toward surface when moving by pressure against the bias in spring 42.

Figure 2A:
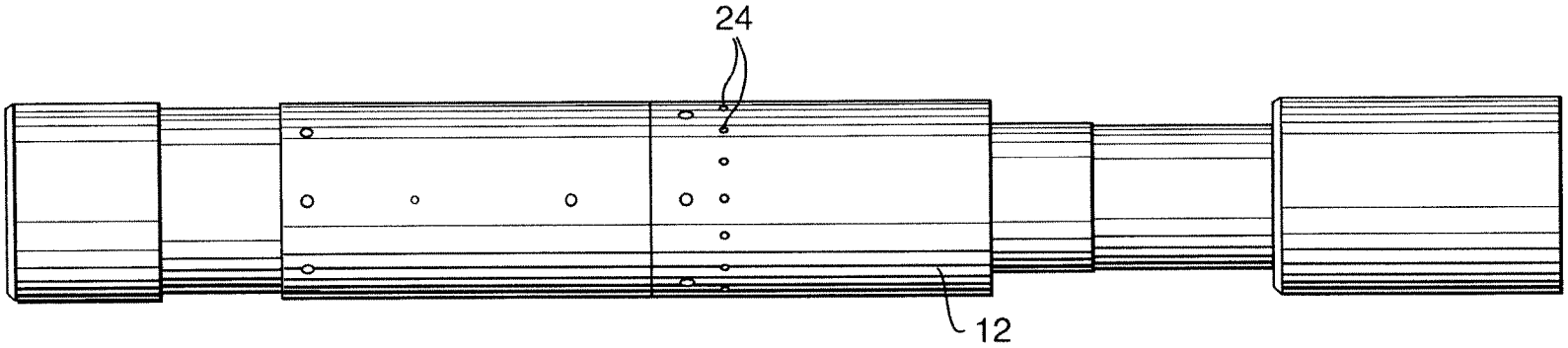
FIG. 2A is a top plan view of a wellbore tool in a run-in hole position.
Figure 2B:
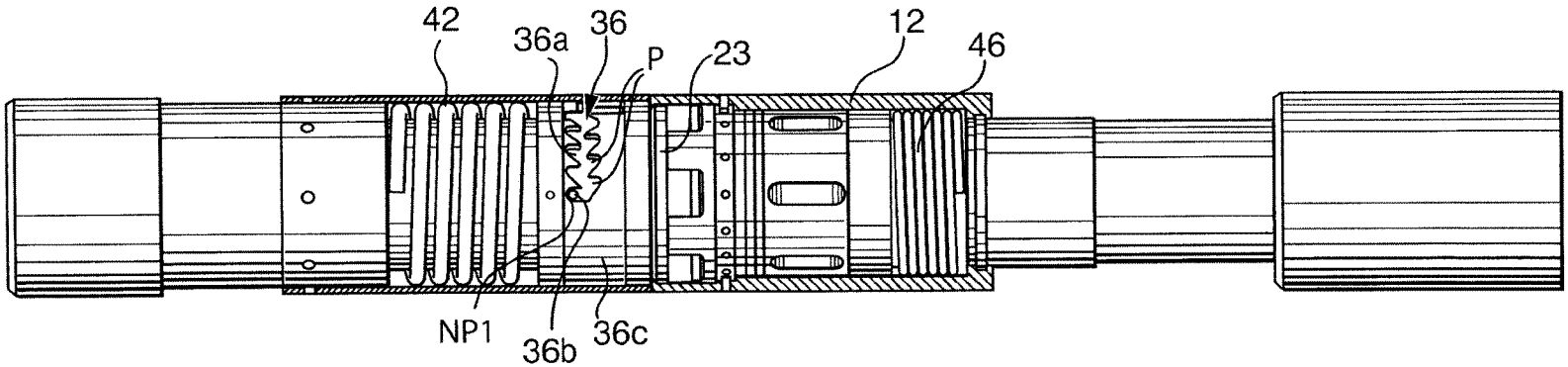
FIG. 2B is a top plan view of the wellbore tool of FIG. 2A with outer parts (sleeve 12 and the housing about spring 42) cut away to illustrate the underlying components.

Movements of piston 34 are controlled by a restraining member 36 such as a j-slot 36*a* and a key 36*b*. One part of the restraining member, here slot 36*a*, is carried on piston 34 and the other part, herein key 36*b*, is positioned adjacent to the piston but on a fixed surface that does not move with the piston, such as on the housing about the pressure isolator. In the illustrated embodiment, slot 36*a* is positioned on a ring 36*c* that is secured to move axially with piston 34, but ring 36*c* can rotate relative to piston 34, so that slot 36*a* can be moved relative to key 36*b* (FIG. 2B). Piston 34 is secured to move only axially, arrows A, along housing 20. For example, to permit axial movement while rotational movement is restricted, piston 34 can include anti-rotation fingers 35 that ride in axial slots in the tool housing.

Restraining member 36 allows piston 34 to be moved from a run-in-hole (RIH) position (FIG. 1A) to an inactive, final release position (FIG. 5A). Piston 34 can be held, as by spring 42, to only begin to move when a certain differential is achieved thereacross and spring 42 ensures that piston 34 returns to the neutral position when insufficient pressure is communicated through port 38.

The j-slot 36*a* can be shaped to control the movement of piston 34 and only when key 36*b* reaches a release position on j-slot 36*a*, can the piston move support wall 32 from under locking member 23 so that it is unlocked.

Thus, the pressure isolator can be inactivated by one or more pressure-up events, wherein the tubing pressure is increased and dissipated, until the final release position is reached. As pressure is increased and dissipated, ring 36*c* shifts axially with piston 34 and slot 36*a* bears against pin 36*b* to limit the axial movement of the piston and to cause ring 36*c* to rotate. In this way, pin 36*b* moves through j-slot 36*a*. The number of pressure-up events necessary to move to the final release position, and thereby the number of pressure-up events allowed before the pressure isolator is inactivated, can be controlled by the shape of the j-slot. After the pressure tests are complete, the pressure isolator may be unlocked and sleeve 12 may be pressure actuated.

In this illustrated embodiment, wall 32 is an extension of piston 34, such that when piston 34 moves, wall 32 moves. While piston 34 and therethrough wall 32 are moved during each pressure-up condition, only when pin 36*b* arrives in the final release position of slot 36*a*, is wall 32 moved axially enough to pull out from under lock 23. At that point, lock 23 no longer secures sleeve 12 and the sleeve can respond to tubing pressure.

In the run in condition, as shown in FIG. 1A, tubing pressure from the inner bore can be communicated to face 12*b*, but the pressure cannot actuate sleeve 12 since releaseable locking member 23 is in place preventing movement of sleeve 12. As such, releasable locking member 24 is protected from feeling the tubing pressure and therefore, cannot be overcome. Once the pressure isolator is inactivated, the locking member 23 can be released and the tubing pressure can act against locking member 24. In particular, sleeve 12 is freed to move by the pressure differential across face 12*b* to overcome locking member 24.

In this illustrated embodiment, the pressure isolator is inactivated moving support wall 32 away from a supporting position relative to releasable locking member 23, such that it can become released from engagement with sleeve 12. The support wall is moved by pressuring up the tubing string against piston 34. The pressuring up may be the actual pressure test.

Thus, the tool allows a controlled port opening, wherein pressure tests can occur while the tubing pressure is actuatably isolated from the sleeve 12. Pressure testing operations can take place over any period of time after the tool, and the string in which it is installed, is positioned in the well. The tool can accommodate many pressure tests and can be set to accommodate any number depending on the form of the j-slot. Thereafter, the releasable locking member 24 is exposed to hold the sleeve in place and is subject to the force of any pressure differential across the sleeve between internal tubing pressure and external pressure. After the pressure isolator is inactivated, the tool can then maintain pressure integrity for an indefinite period until the internal pressure in the tubing inner diameter ID exceeds the holding capability of the member 24. The sleeve then opens.

Figure 3A:
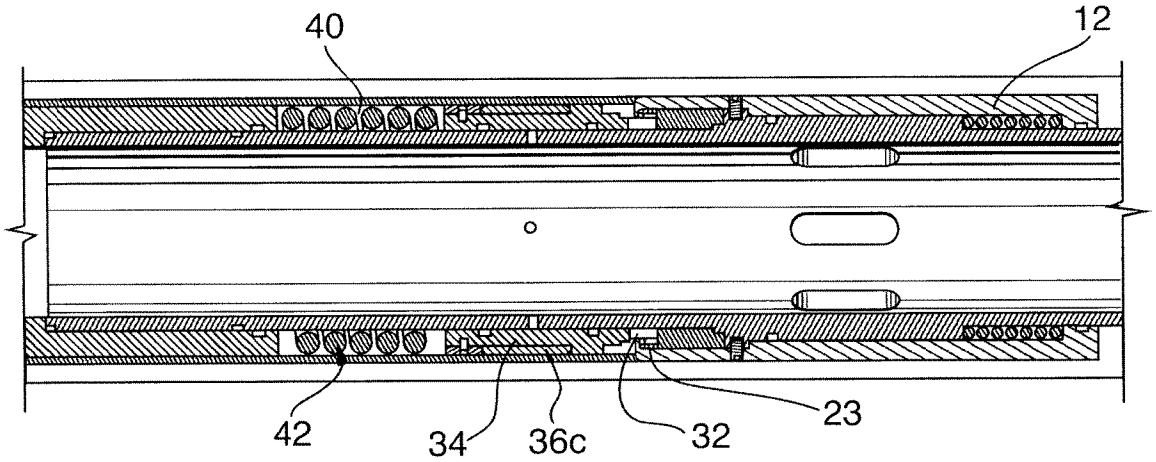
FIG. 3A is a top plan view of a wellbore tool in a pressured up position.
Figure 3B:
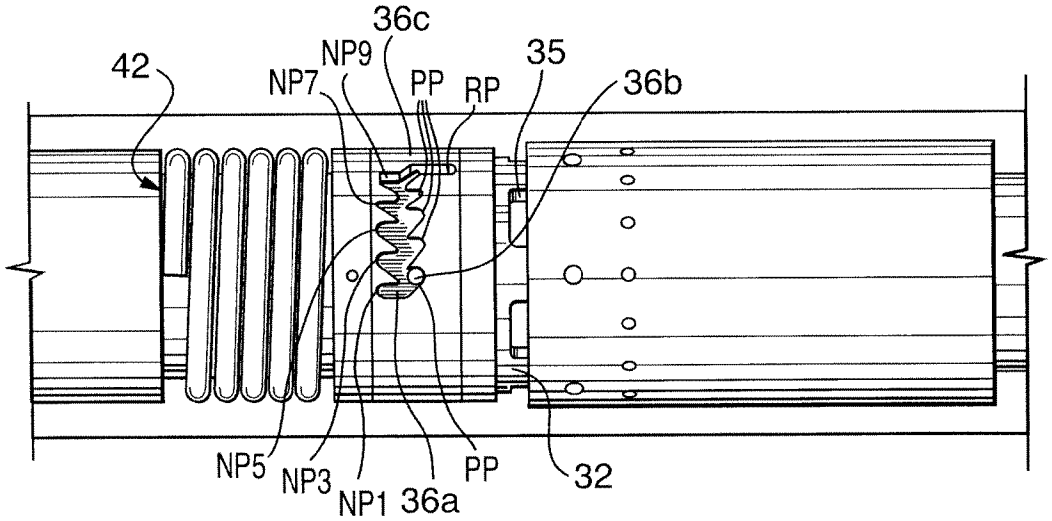
FIG. 3B is a top plan view of the wellbore tool of FIG. 3A with the pressure isolator outer housing (the housing about spring 42 and ring 36*c*) removed.
Figure 4B:
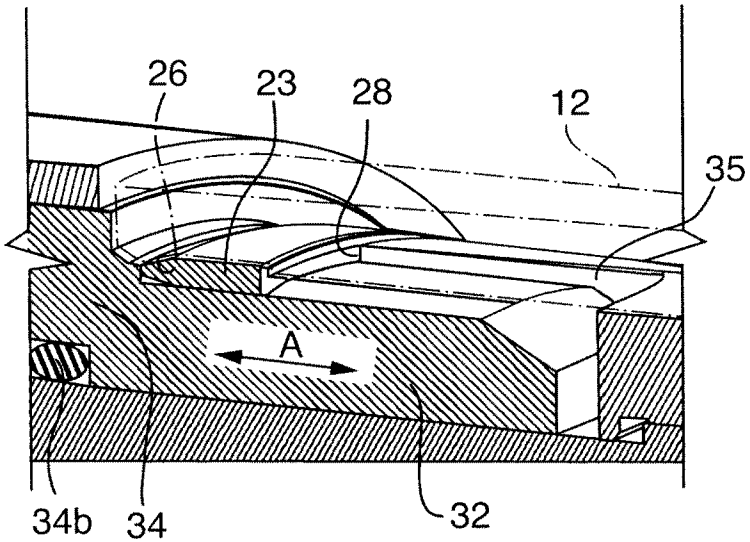
FIG. 4B is a top plan view of the wellbore tool of FIG. 4A with sleeve 12 shown in phantom.
Figure 4A:
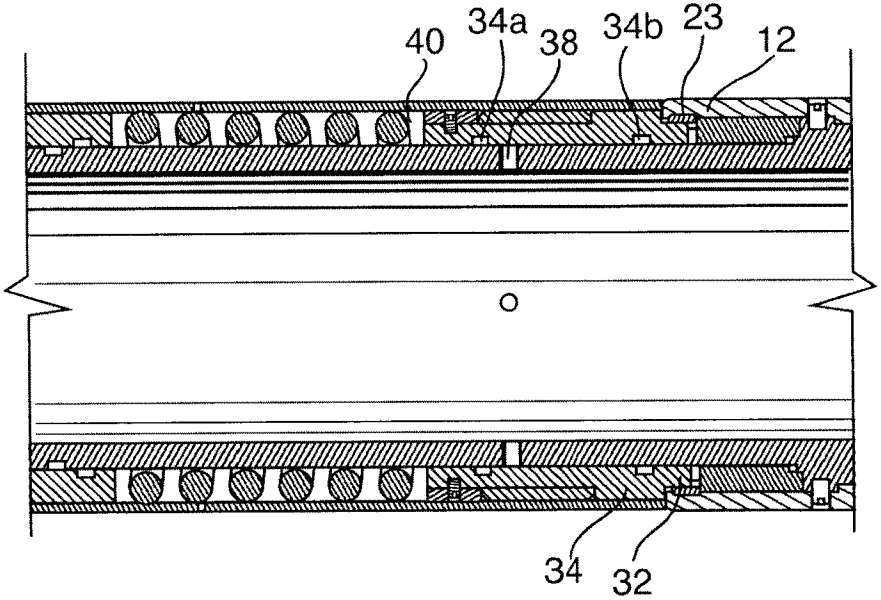
FIG. 4A is a top plan view of a wellbore tool in a pressure released position.

The j-slot is formed to control the movement of piston 34 in response to pressure differentials generated by pressuring up the string and therefore the inner diameter. The j-slot has a one or more neutral position notches. In FIG. 3B, it can be seen that there are five such notches identified as positions NP1, where it is positioned during running in the hole (RIH), NP3, NP5, NP7 and NP9. The j-slot also has a number of pressured up position notches PP. The j-slot also has a final releasing position RP, which has an axial depth extending beyond the axial depth of the PP notches. The j-slot is formed such that during each pressure up condition, where tubing pressure is elevated above the pressure in chamber 40, piston 34 moves against the bias in spring 42 to move key 36*b* relative to slot 36*a* from a neutral position notch NP to a pressured up position notch PP (FIG. 3B) and when pressure is dissipated the piston moves back by the bias in spring 42 such that key 36*b* returns to a neutral position notch. The shape of the slot 36*a* forces the key to a next neutral position notch rather than back into a previous one. Finally, on a last pressure up condition, key 36*b* moves into the final releasing position RP.

The piston moves the slot 36*a* relative to the key 36*b*, but the form of slot 36*a* restricts the movement of the piston according to the shape of the slot. The shape of j-slot 36 restricts movement of piston 34 through a short axial range except when the final releasing position is reached. At that point, piston 34 can move axially further than previously permitted. Support wall 32 is carried on piston 34 and underlies member 23. The range of the piston's permitted axial movement when moving from the neutral positions NP to the pressure up positions PP is insufficient to remove wall 32 from its supporting position under member 23. In particular, even though piston moves axially to move from NP positions to PP positions (such as during pressure tests), locking member 23 remains supported by wall 32, thus locking member remains actively securing sleeve 12 and the sleeve cannot move. However, the range of the piston's axial movement when moving from the neutral positions NP to the final release position RP is sufficient to remove (i.e. axially move) wall 32 from under member 23.

Sleeve 12 is held in place by releasable locking member 24 even after the locking member 23 of the pressure isolator is removed from engagement with the sleeve. Member 24 ensures that sleeve can only be moved to open ports 11 if sufficient pressure differential is felt across the sleeve between the inner diameter and the annulus. Thus, depending on the pressure rating of member 24 the sleeve may be opened separately from the unlocking of member 23 or at the same time as the unlocking of member 23. In particular, if the process to unlock locking ring member 23, which does require a pressure-up event to move key 36*b* along slot 36*a*, fails to exceed the pressure rating for member 24, sleeve 12 will remain secure until the pressure is raised above the pressure holding capacity of member 24. On the other hand if the process to unlock locking ring member 23 raises pressure above the holding strength of the member 24, the sleeve will move as soon as member 23 is unlocked.

The releasable locking member 24 does ensure however, that if normal pressure conditions within the well, such as a vacuum pressure at the formation or another failure, inadvertently move piston 34, sleeve 12 will remain closed until the tubing string is pressured up to a condition beyond the holding capacity of member 24.

Since pressure tests tend to raise tubing pressure well beyond the normal pressures for operating hydraulically operated tools, it is not likely that the pressure holding capacity of member 24 will be higher than that pressure used for pressure tests. Thus, if it is desired to keep the tool closed until after the pressure tests are complete, slot 36*c* may be formed with enough notches to do the required pressure tests plus at least one more pressure up condition. With at least one extra notch, the tool can be held for an indefinite period before opening the sleeve 12.

In addition, the tension of spring 42 can be selected to permit particular functioning of the tool. In one embodiment, for example, the tension of spring 42 may permit pressure actuations of piston 34 at pressures less than a pressure test pressure and that together with selection of the pressure holding capability of member 24 to be more than the differential generated by the last pressure-up condition may additionally permit an indefinite delay on sleeve opening following the pressure test. Alternately, to move into the final release position, spring 42 may require additional compression to allow the necessary additional piston movement. As such, the tubing pressure required to move the tool into the final release position may be greater than the pressures required to move the pressure isolator through the preceding cycles. This offers a safety step, where the operator must increase the pressure to a higher level in order to finally release locking member 23.

In particular, if member 24 has a holding capability sufficient to hold against the last pressure up condition (i.e. the condition that moved key 36*b* from the last neutral position to the final release position RP), the member 24 can hold the sleeve until tubing pressure is again elevated beyond the holding strength of the member 24.

Since the sleeve is exposed at all times to the tubing pressure, however, if member 24 has a holding capability insufficient to hold against the last pressure up condition (i.e. the condition that moved key 36*b* from the last neutral position to the final release position RP), the member 24 will immediately fail to release the sleeve.

A sleeve retracting spring 46 may be provided to ensure that sleeve 12 retracts from over ports 11 even if the sleeve has been sitting in wellbore conditions for some time. Spring 46 also ensures that sleeve 12 remains retracted once member 24 is overcome.

With reference to the Figures, a method is illustrated for manipulating the tool from a run in hole position (FIGS. 1A to 2B), to a pressure up condition (FIGS. 3A and 3B), to a pressure release position (FIGS. 4A and 4B) where key 36*b* will move into a neutral position notch, for example position NP3, and finally to a final release position RP (FIGS. 5A to 5C) where member 23 is unlocked and ports 11 may be opened.

In the method, tool 10 is installed in a string 2 and the string and tool are run into the wellbore, defined by wellbore wall 3, to a desired position.

To open port 11, the releasable locking member 23 of the pressure isolator must be inactivated and to do so the tool must be pressured up and then the pressure dissipated to move key 36*b* through the slot 36*a*. The pressure up cycles may be specific to prepping the tool for port opening. However, the tool can be actuated by the pressure cycles intended by the operator to test string integrity.

Piston 34 in the pressure isolator senses the pressure pulses to move the slot 36*a* relative to the key 36*b* such that the key moves from notch to notch in the slot. Piston 34 can be biased against movement until a particular tubing pressure is reached. In one embodiment, for example, the piston is biased by spring 42 and can only move when a particular pressure differential is reached between inner diameter ID and chamber 40, which is open to annular pressure. In one embodiment, the tubing pressure need not be as high as a pressure test but is higher than the pump pressures reached during string installation and hydrostatic pressures. However, the pressure isolator mechanism can readily accommodate the test pressures.

In the tool illustrated in the Figures, it is necessary to pressure up and release pressure four times to move the tool from position NP1 to the final release position. If the operator wants to conduct fewer pressure up cycles, key 36*b* could initially be positioned in one of the mid positions or the j-slot could be made with fewer notches. Likewise, if the operator wanted to conduct more than four pressure up cycles, the j-slot could be made with more notches. The pressure cycles can be for pressure testing or simply to move the tool through the j-mechanism.

In one embodiment, there will be enough notches in the j-slot to accommodate a selected number of pressure tests wherein the pressure will be raised to the pressure ensuring tubing integrity, such as in excess of the pressure holding capability of second releasable locking member 24, for example at or beyond about 2500 psi or sometimes beyond 4000 psi and there will be at least one further notch for a final pressure-up condition, when desired and possibly delayed a period of time from the first pressure tests. The final pressure-up condition is the one that inactivates the pressure isolator and permits the sleeve to be opened by hydraulic actuation.

By selection of the tension in spring 42, pressures greater than normal pump pressure may be required to move the pressure isolator through the j-slot, but the pressures for actuation can be selected depending on the desired functioning of the tool. In one embodiment, pressure test pressures are needed to move the pressure isolator through the stages and even into the final release position. As such, the final pressure up condition generally also opens the sleeve at the same time as the final release position is achieved. Alternately, the tool may be selected such that pressures to move through the stages of the j-slot need not be as high as pressure testing pressures so that, if desired, pressures capable of moving the pressure isolator into the final release position need not be so high.

This permits control of pressures necessary to move the pressure isolator into the final release position, possible movement to the release position without simultaneous opening of sleeve and/or control of pressures communicated to the formation.

Figure 7:
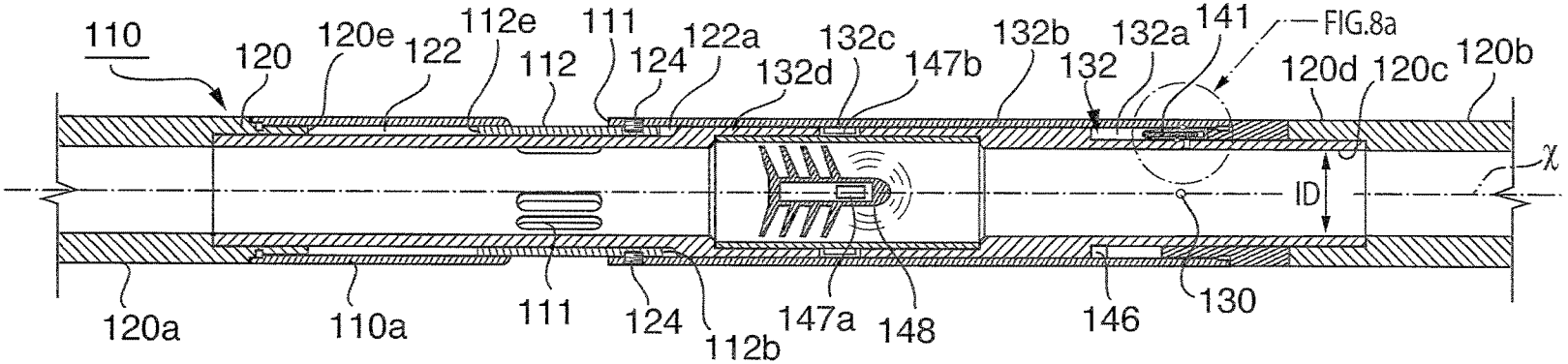
FIG. 7 is a sectional view through a wellbore tool in a run-in position.
Figure 8B:
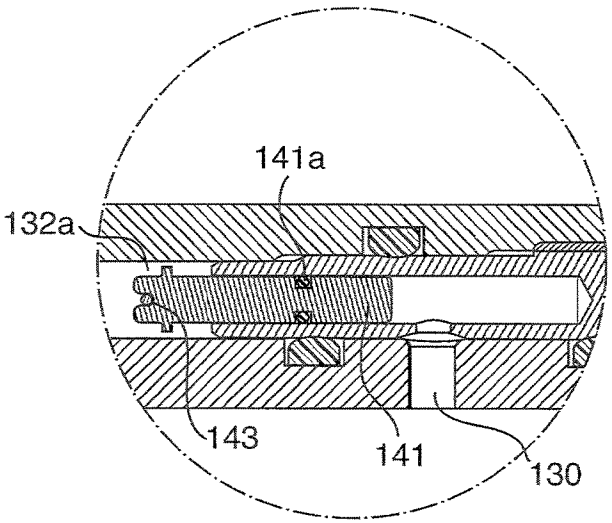
FIG. 8*b* is an enlarged view of another pressure isolator useful in the present invention.
Figure 8A:
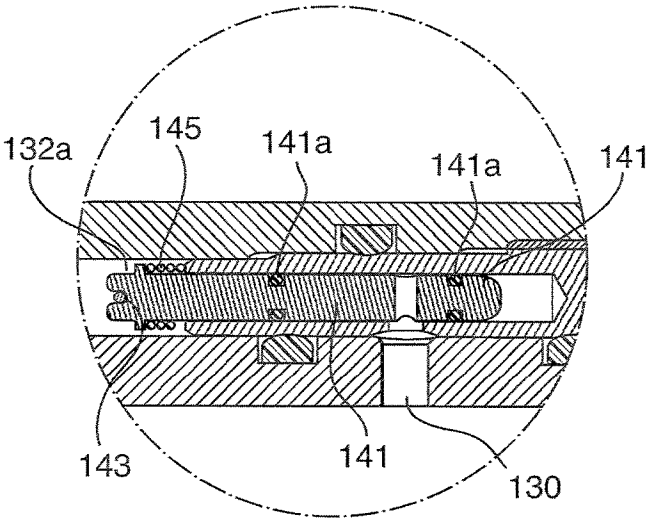
FIG. 8*a* is an enlarged view of area A in FIG. 7.

With reference to the FIGS. 7, 8*a* and 8*b*, there is shown another tool 110 intended to function primarily as a ported, fluid treatment tool. The tool has one or more ports 111 which are openable to provide access between the tubing string inner diameter and the tubing string outer surface, which in use is in the annular area between the tubing string and the wellbore wall.

The tool, as shown here, is capable of withstanding a pressure test without concern of the port closure being opened during the pressure test. In particular, if the closure is a sleeve or piston or if the closure is a burst disk, the shear screw or burst disk "high/low" holding tolerances are not of consequence to the pressure test. In particular, the pressure holding tolerances of the closure may be below the pressures achieved during the pressure test.

The purpose of the tool may depend on its position in the well. For example, the tool may be useful as a toe port tool, which is a tool installed adjacent the distal end, or toe, of the tubing string. The toe port tool may be used to create fluid conductivity to the annulus and/or for fluid treatment. If the tool is positioned closer to surface, it may not be considered a toe port tool, but rather a fluid treatment tool. It may be employed, for example, alone or in series along a length of the tubing string. The tools may have the same structure regardless of whether they are used as a toe port or a fluid treatment tool, its operation being dependent on its position in the well and the closure mechanism used to open the port.

The tool includes a tubular housing 120 including an upper end 120*a*, a lower end 120*b*, an inner surface 120*c* defining inner diameter and an outer surface 120*d*. Although not shown, the sliding sleeve tool, may be formed as a sub with its tubular housing 120 having ends 120*a*, 120*b* threaded or otherwise formed such that it may be connected into a wellbore tubular string. The housing defines a long axis x extending concentrically relative to inner surface 120*c* through ends 120*a*, 120*b*.

Tool 110 includes ports 111 through the wall thereof that, when open, provides fluid access from the inner diameter ID to the outer surface 110*a*. A sleeve 112 controls the open and closed condition of ports 111.

The open and closed condition of ports 111 is determined by sleeve 112. The sleeve is axially moveable in the tubular housing between a position blocking and closing ports 111 (FIG. 7) and a position at least partially retracted from, and therefore opening ports 111. In the open position in the embodiment, sleeve 112 would be moved toward end wall 120*e*, such that end 112*a* is closer to end wall 120*e*.

In this embodiment, sleeve 112 is positioned in a chamber 122 in the wall of the tubular housing such that a hydraulic chamber 122*a* is formed within chamber 122 at one end 112*b* of the sleeve. The ports 111 extend through the wall and intersects chamber 122, such that sleeve 112 may be moved in chamber 122 from a position blocking ports 111. Chamber 122 is large enough between ports 111 and end wall 120*e* to permit the movement of the sleeve away from ports 111.

Sleeve 112 is held in the blocking position by one or more releasable locking members 124. Sleeve 112 can be moved to open ports 111 when the holding strength of releasable locking members 124 are overcome by the force created by the pressure differential across sleeve 112 from pressure on end 112*b* to the pressure in chamber 122 between end wall 120*e* and sleeve end 112*e*. Releasable locking members 124 may, for example, be shear pins (as shown), c-rings, engaging fingers, etc. rated for their pressure holding capability, responsive to the pressures to be communicated to chamber 122*a* relative to the pressure in chamber 122 between end wall 120*e* and sleeve end 112*e*.

Pressure from inner diameter ID may be communicated to chamber 122*a* through port 130 and passage 132. Passage 132 includes chamber 132*a* and annular spaces 132*b*, 132*c* and 132*d*.

A pressure isolator controls pressure communication through passage 132 to chamber 122*a*. Here the pressure isolator is in the form of a pin 141 positioned in chamber 132*a* adjacent port 130. Pin 141 is held in place by a retention member 143, which in this embodiment is a strong, but heat destructible, string, which for example may be formed of a polymer such as an aramid, one source of which is known as Kevlar™. Pin 141, when in place as shown, isolates tubing pressure (i.e. the pressure in inner diameter ID) from hydraulic chamber 122*a*. For example, pin 141 includes seals 141*a* that create a fluid tight seal between the pin and the walls of the chamber 132*a*.

In the illustrated embodiment shown in FIG. 8*a*, pin 141 is installed in a pressure balanced condition relative to port 130. In particular, seals 141*a* straddle port 130 and provide an equal surface area on either end of the pin such that pressures against the pin at port 130 do not tend to drive the pin in chamber 132*a*. This offers a safety feature such that even at high tubing pressures, the pin tends to stay in place, as any pressure is balanced across seals 141*a*. Alternatively, pin 141 may be installed to feel a pressure differential thereacross, as shown for example in FIG. 8*b*. A pressure differential set up may be more useful if there is a risk of port 130 plugging (i.e. as with residual cement) before the pin can be removed. If there is a risk of plugging, however, it may be useful to provide a filter for the port 130.

In the run in condition, as shown in FIG. 7, pin 141 is in position such that pressure from inner diameter ID cannot be communicated to chamber 122*a*. As such, releasable locking members 124 are protected from feeling the tubing pressure and therefore, a pressure differential is not generated thereacross. Once the pin, as pressure isolator, is inactivated, the tubing pressure can reach chamber 122*a*. Once pin 141 is inactivated, sleeve 112 is exposed to the tubing pressure (i.e. the pressure in inner diameter), as the pressure is communicated through port 130 and passage 132 to chamber 122*a*. The pin can be inactivated by being released from a retained position (and therefore capable of moving), by removal from a sealing position or by having its seals overcome to permit fluid passage thereby.

In this illustrated embodiment, pin 141 is inactivated by overcoming the retention member 143, which may include significantly weakening, as by destroying, the string. A pressure balanced pin 141, as shown, may be released and removed from its sealing position to open communication. Pin 141 may be biased to move out of its plugging position when retention member 143 is overcome. For example, during run in passage 132 and chamber 122 may be at atmospheric pressure such that any tubing pressure greater than the pressure of fluid in chamber 132*a* tends to push pin into the chamber. Alternately or in addition, a spring 145 may be employed to bias pin 141 out of its plugging position, for example, into an enlarged area of chamber 132*a* where seals 141*a* can no longer act. Thus, it may not be necessary to raise pressure to remove pin 141 and open communication to the chamber 122*a*. As such, the pin 141 will be removed and passage 132 opened as soon as string 143 is removed. If a pin was used that was installed to have a pressure differential established thereacross, then the biasing force may not be necessary to remove the pin.

Thereafter, because pin is inactivated and the passage 132 is open or can be opened, there can be fluid communication to chamber 122*a*. Therefore, tubing pressure can be increased to develop a pressure differential. The force generated from this pressure differential acts on releasable locking members 124. When the pressure in the inner diameter exceeds the holding strength of the releasable locking members 124, then sleeve 112 is shifted away from ports 111 to the open position. In this illustrated embodiment, the holding strength is the shear value provided by the total pressure rating of the sleeve's shear pins 124.

Thus, the tool allows a controlled port opening, wherein pressure tests can occur while the tubing pressure is isolated from the sleeve 112. Pressure testing operations can take place over a period of time after the tool, and the string in which it is installed, is positioned in the well. When the period of time expires, the shear pins 124 are exposed to the internal tubing pressure. The tool can then maintain pressure integrity for an indefinite period until the internal pressure in the tubing inner diameter ID exceeds the holding capability of the shear pins 124. The sleeve then opens.

Retention member 143 is overcome when a signal is received. The signal may be any of various means such as hydraulics, electronics, radio signals, electro-magnetic signals, etc. In this embodiment, the signal is generated by and/or processed through a controller 146, and the signal causes destruction of the string 143. The controller may include a timer and related components (i.e. electronics, batteries, electrical components), and/or a receiver to pick up an external signal and/or a generator to emit signal. Thus, the signal from the controller to the string may be through an electrical supply and/or a conductor.

In the illustrated embodiment, controller 146 acts as a receiver, delay and signal generator. controller 146 includes a receiver for receiving an external signal, a timer that is started when the external signal is received (whether on surface, prior to installation, or after installation while in the wellbore) and a signal generator to generate, when the timer so indicates/permits, a signal to destroy the string 143.

In particular, the embodiment of FIGS. 7, 8*a* and 8*b* involves the sensing of an electro-magnetic signal from an emitter 148*a* in a sending unit 148. The sending unit is conveyable through the inner diameter of the string, and thereby through the tool 110 connected into the string. For conveyance, unit 148 may for example launched from above, be moved by gravity or fluid pressure. It does not require a connection to surface. Unit 148, for example, may have a plug form and may be launched from surface and may be pumped down the tubing string. While other plug forms are possible, such as for example a ball, in the illustrated embodiment unit 148 has the form of either a wiper plug, used during cementing applications, or a pump down activator, as shown. A pump down activator may be useful in an open hole completion, where a plug with the larger diameter and heavy wiper seals of a wiper plug is not required.

The tool may include a power supply, such as for example a battery, and a conductor to convey an electrical current to destroy the string. The dart may also include a power supply in order to allow it to emit the external signal.

Alternately, the tool may be devoid of a power supply but the system may rely on a "wet connection" between the dart and the tool. In this way, the dart may have a power supply and power is supplied to the tool via the wet connection to remove the retention member.

In one embodiment, the dart emits an electro-magnetic signal. The electro-magnetic signal is emitted via a primary coil 147*a* in the dart and is detected via a secondary coil 147*b* on the tool. This system is reliable and is immune to orientation issues due to the 360° signal generation of the primary coil 147*a*.

Since sleeve 112 is opened separately from the opening of the communication port, the tool permits an indefinite delay on sleeve opening following the pressure test. In particular, the pressure isolation, as provided by pin 141 in passage 132, permits tubing pressure to be isolated from sleeve 112. The releasable locking members 124 are not exposed to tubing pressure and therefore not exposed to the force of any pressure differential, until the pressure isolator is removed. Prior to this the tubing pressure can be raised to levels higher than the holding capability of the members 124. In addition, even after the pressure isolator is removed, the releasable locking members 124 hold the sleeve in place and the sleeve cannot be moved until tubing pressure is raised to overcome members 124.

Figure 9:
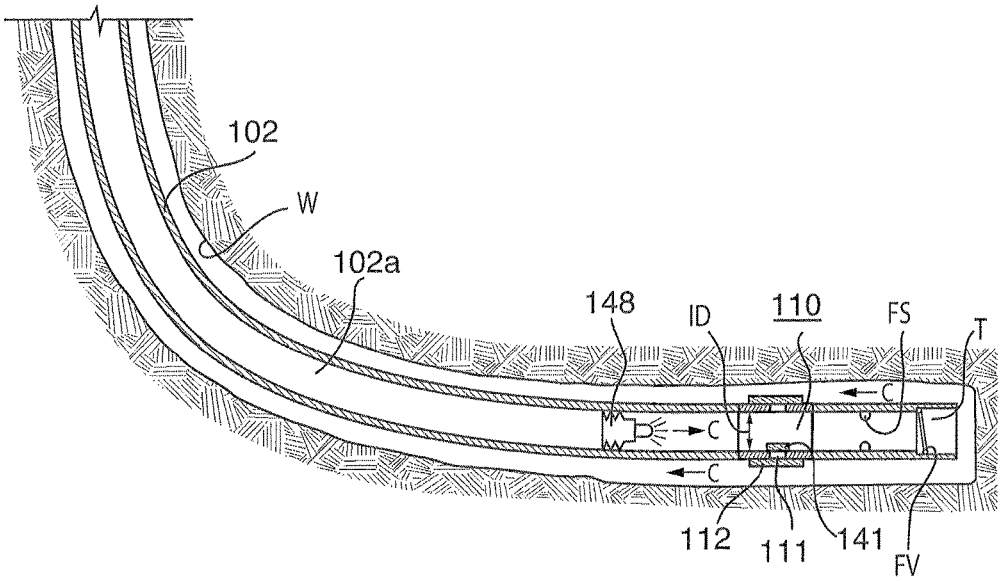
FIG. 9 is a sectional view through a wellbore having positioned therein a tool and showing a method according to the present invention.

With reference to FIG. 9, a string 102 including tool 110 installed therein may be run into a wellbore W. Tool 110 may be installed at various locations along the string such as, for example, at the distal end adjacent toe T or closer to surface. There may be more than one tool similar to tool 110 and there may be other tools.

During run in, tool 110 is in a run in mode, with its ports 111 closed by a closure 112 and a pressure isolator 141 isolating tubing pressure from the closure. With reference to the tool of FIG. 7, the run in mode is shown, wherein sleeve 112 covers ports 111 and pin 141 acts as a pressure isolator to isolate tubing pressure from bore 110*a* from being communicated to the sleeve.

When in position, pressure tests may be conducted through the string. While the tool's closure 112 is openable by a pressure differential thereacross (i.e. for example, sleeve 112 secured by releasable holding members 124 that are able to be overcome by a certain pressure differential between the pressure acting on end 112*b* and the pressure acting on sleeve end 112*e*), the pressures developed during the pressure tests are irrelevant to the closure due to the pressure isolator. In particular, tubing pressure in ID is isolated from the sleeve via a pressure isolator, which is illustrated in FIG. 7 in the form of pin 141. Pressure tests may, therefore, raise the tubing pressure to a test pressure that is well above the holding capability of the closure without concern as to the effect on closure. In addition, pressure tests may require holding the test pressures for prolonged periods. Again, there is little concern that these test pressures will inadvertently open the sleeve even if the test pressure is maintained for significant periods.

When pressure tests are completed the pressure isolator is signaled to be inactivated. When inactivated, tubing pressure in the inner diameter 102*a* of string 102, which is common to the inner diameter ID of tool 110, can be communicated to closure 112. Thereafter, when the tubing pressure is elevated to a level above the holding capability of closure 112, the closure is operated to open ports 111.

The pressure isolator may be signaled in various ways to open communication to the closure. For example, the tool may carry a controller that signals the pressure isolator to be inactivated at an appropriate time, such as two weeks after installation. Alternately, pressure isolator 141 may be signaled to be inactivated by an external signal. In an embodiment using an external signal, tool 110 may include a controller that receives the external signal and relays it in an appropriate form to actuate the pressure isolator. Additionally, as desired, such a controller may further include a timer such that the external signal, when received, does not automatically cause pressure isolator 141 to be inactivated, but instead starts a set delay time after which the pressure isolator is inactivated.

In the illustrated system of FIG. 9, an external signal is communicated to the pressure isolator to inactivate it after a time of delay. In particular, an emitter in a dart 148 provides an external signal which starts a timer and eventually a signal is generated to inactivate the pressure isolator.

Dart 148 is released from above tool 110 and is conveyed to the tool by pumping or gravity. The proximity of dart 148 to tool 110 signals the pressure isolator to be inactivated. In this embodiment, the inactivation of the pressure isolator involves the sensing of an electro-magnetic signal, which is reliable and immune to orientation, emitted by the dart. The dart 148 need not and in this embodiment does not, physically manipulate the pressure isolator. The dart 148 passes through tool without becoming engaged in it such that the dart is free to act further down the string. According to an exemplary implementation, dart 148 is untethered and dropped or pumped through the string.

The dart may be released to pass through the string at any time. For example, it can be conveyed in fluids circulating through the string as or after it is run in hole. For example, in the illustrated embodiment, dart 148 also acts as a wiper dart launched behind cement, arrows C, to wipe the cement from the string. Cement exits from a float valve FV at toe T. Dart 148 is pumped through tool 110 and after passing the tool, lands in a float shoe FS and seals the string. Thus, dart 148 serves two purposes.

Figure 10:
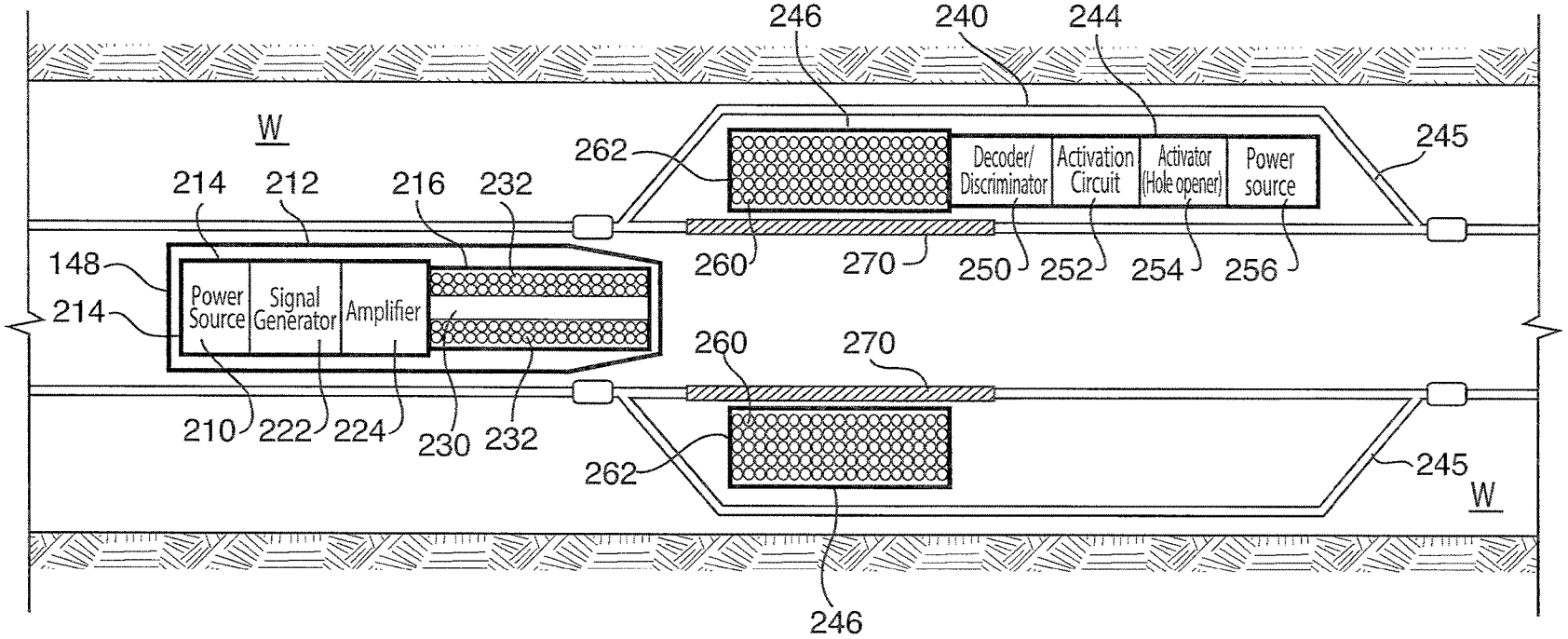
FIG. 10 is a schematic of downhole equipment for use with the tool in FIG. 9 and a dart, according to one embodiment of the present invention.

In one embodiment, as shown in FIG. 10, dart 148 comprises a housing 212, a transmitter module or transmitter electronic circuit module 214 and an antenna module 216. The housing 212 comprises a generally cylindrical shape and is fabricated or formed, in known manner, from a composite, composite-metallic material or other high strength material capable of withstanding pressures and other stressors normally experienced in the wellbore W. According to another aspect, the material for the housing 212 is selected so as not to substantially attenuate the emitted signal.

Referring to FIG. 10, the electronic circuit module 214 may comprise a power source 220, a signal generator 222 and an amplifier circuit 224. The amplifier module 224 may be configured to amplify the output of the signal generator (i.e. the free running oscillator) 222 and drive the antenna 216. The antenna module 216 is operatively coupled to the amplifier 224 and configured to convert the output signal into an electromagnetic signal (i.e. a transmit output signal) that is coupled and decoded by downhole equipment 240 as described in more detail below. According to an embodiment, the antenna 216 comprises an inner solid steel core 230 and a coil exterior 232, for example, a coil wound around the steel core 230 using known techniques. As shown, the antenna 216 is mounted axially in the housing 212. The electronic circuit module 214 comprises discrete and/or integrated electronic components mounted on a circuit board or other suitable carrier installed inside the dart 210. The specific implementation details will be readily apparent to one skilled in the art.

The downhole equipment 240 comprises a housing or casing 245, and a receiver module including a receiver electronic circuit module 244, and an antenna module 246. The downhole equipment 240 is integrated or installed with tool 110. For example, tool 110 is configured with a compartment or housing component suitably sized or dimensioned to receive the electronic circuit module 244 and the antenna module 246.

As shown in FIG. 10, the antenna module 246 is configured to couple the electromagnetic signal(s) emitted (i.e. transmit output signal) by the antenna 216 on dart 148 as dart 148 comes into proximity and generate an output signal which is fed to the receiver electronic circuit module 244. According to an embodiment, the receiver antenna module 246 comprises a coil 260 wound on a core 262. The core 262 comprises a hollow and non-metallic bobbin according to an exemplary implementation. As shown, the antenna 246 is positioned axially in downhole equipment 240 and surrounds a portion of the tubing string, or according to another embodiment, a section of the tubular housing of tool 110, as described in more detail below. According to another aspect, downhole equipment 240 (or tool 110) comprises a section of material indicated generally by reference 270, which does not attenuate the magnetic field and thereby facilitates coupling and reception between the transmitter antenna 216 in dart 148 and the receiver antenna 246 in downhole equipment 240. Suitable material for the section 270 includes inconel.

The receiver electronic circuit module 244 comprises a decoder/discriminator circuit 250, an activation circuit 252, an activator or actuator 254 and a power source 256. The power source 256 is configured to supply the circuits and may be implemented as a low power DC power source comprising one or more batteries. The decoder/discriminator circuit 250 receives the output signal from the receiver 246 and is configured to decode, and/or recognize, the output signal and generate an activation output signal for the activation circuit 252 if the received signal is intended, i.e. addressed, to downhole equipment 240. The received signal can have a signature based on frequency, polarity, pulse width, pulse number, number of pulses, etc., and the particular implementation details will be within the understanding of one skilled in art.

The activation circuit 252 is configured to be responsive to an output from the decoder circuit 250. The output is generated in response to decoding a signal intended for the downhole equipment 240. According to an embodiment, the activation circuit 252 comprises a current source which is responsive to the output signal from the decoder 250. The current source may be implemented using discrete components, e.g. transistors, or integrate components, as will be within the understanding of one skilled in the art. According to an exemplary implementation, the activator 254 comprises a wire or strip that is coupled to the output of the current source, and in response to activation of the current source, the wire is heated by the current to a temperature and/or duration sufficient to melt or burn a section of a Kevlar string or the like which retains a trigger mechanism (e.g. pressure isolator 141) coupled to or integrated with tool 110. In one embodiment, downhole equipment 240 further includes a timer to selectively delay the emission of the output signal from the antenna 246, the emission of the activation output signal from the decoder 250 and/or the response of the activation circuit 252 after receiving a signal from decoder 250.

Referring to FIGS. 9 and 10, in operation, according to an exemplary implementation, downhole equipment 240 is installed on the tubing string and the tubing string is run in the wellbore W. Adjacent or in the vicinity of downhole equipment 240, tool 110 is installed and operatively coupled to downhole equipment 240. The dart 148 is dropped or pumped through the tubing string in the wellbore W. According to an exemplary implementation, the electronic circuit module 214 and the antenna module 216 for the dart 148 generate and emit a magnetic field with an alternating polarity (e.g. 180 degrees) and frequency of 400 Hz. When the dart 148 passes by the downhole equipment 240, the antenna 246 detects and receives the magnetic signal emitted by the dart 148 and generates an output signal. The output signal is processed, e.g. decoded, by the electronic circuit module 244 and trigger output is generated and operatively coupled to tool 110. According to an embodiment, the pressure isolator 141 is held in place by a heat-destructible string and the pressure isolator isolates tubing pressure from closure 112 when held in place (i.e. when activated). The trigger output causes electronic circuit module 244 to heat up a heat element to a temperature sufficient to melt the string to release the pressure isolator 141, thereby inactivating same.

According to another mode of operation, the dart 148, i.e. the electronic circuit module 214 is configured to generate a magnetic output signal with a predetermined signature or identification characteristics. The electronic circuit module 244 in the downhole equipment 240 is configured to decode the magnetic output signal and discriminate or recognize magnetic output signals having a characteristic predetermined signature. Upon detection of the specified or programmed signal, the electronic circuit module 244 generates the trigger output, for example, as described above.

According to yet another mode of operation, when dart 148 passes through the tool, the signal emitted thereby is received by downhole equipment 240 and a time delay is initiated. The time delay is sufficient to allow the cement to set and for pressure tests to be conducted. In one embodiment, the time delay is one or more weeks. When the time delay expires, pressure isolator 141 is inactivated.

Once the pressure isolator is inactivated, the closure 112 is exposed to tubing pressure. When desired to open ports 111, the pressure may be raised in the tubing string and ID, such that a pressure differential is established across the closure that is sufficient to overcome it and open ports 111. This can be done any time after the pressure isolator is inactivated.

The closure may be selected to have a holding capability able to hold against the well's normal hydrostatic pressures and differentials generated thereby. It can also be capable of holding against other annular or tubing pressures, such as those to set packers, etc. As such, even with the necessary tests for string integrity, the operator can control when the ports are opened and, thus, when the tubing string ID is opened to the formation.

In alternative embodiments, the pressure isolator can be inactivated without the use of a dart, a sending unit, or the like. For example, a pressure switch may be installed in or connected to the tool and the pressure switch is programmed to sense a predetermined pressure in the tubing string. The tool has a pressure isolator that, when activated, isolates a closure from tubing pressure. To trigger the inactivation of the pressure isolator, pressure is increased inside the tubing string. When the pressure switch senses that tubing pressure has reached the predetermined level, the switch activates the electronic components in the tool to inactivate the pressure isolator. The inactivation of the pressure isolator may optionally be selectively delayed from when the predetermined pressure is reached. Once the pressure isolator is inactivated, the closure is exposed to tubing pressure, allowing ports in the tool to be opened as described above.

Figure 11:
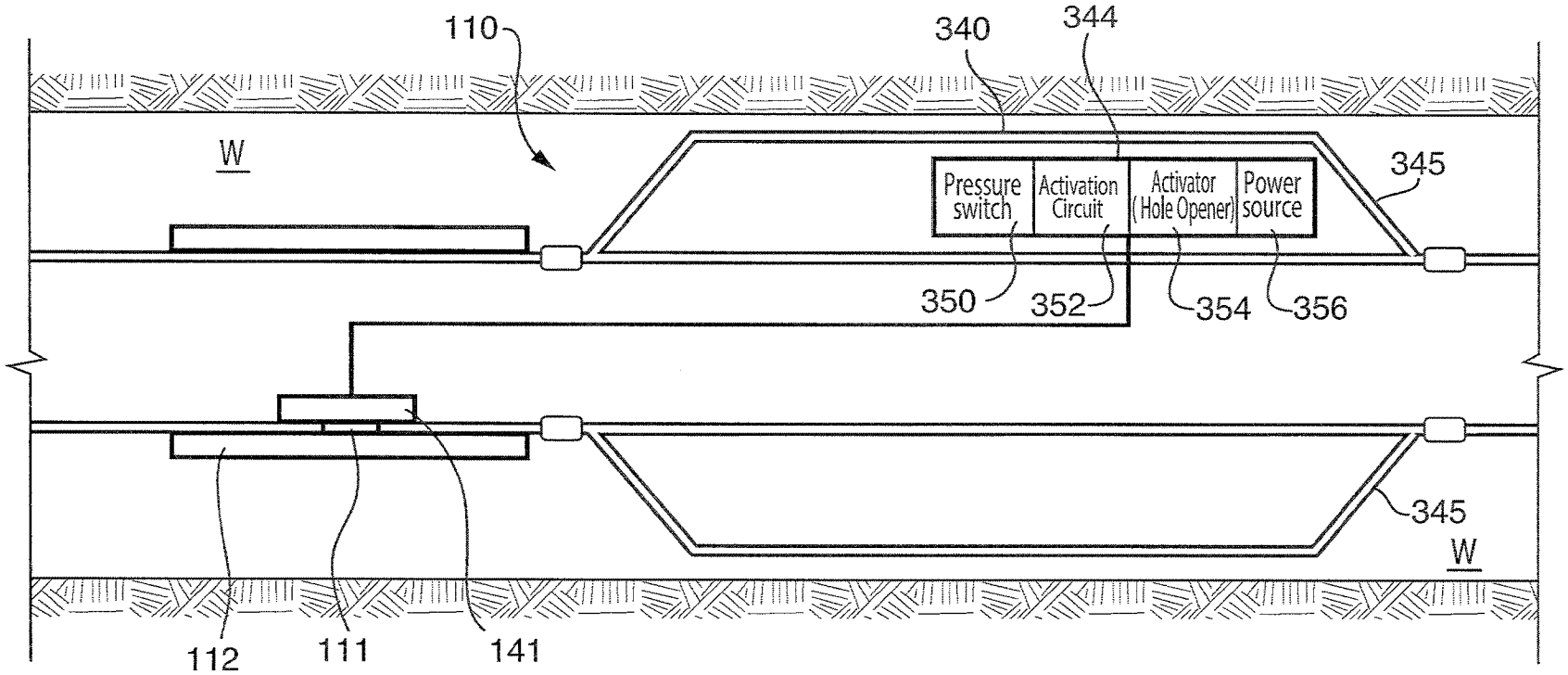
FIG. 11 is a schematic of downhole equipment according to another embodiment of the present invention.

With reference to FIG. 11, in an exemplary embodiment, a string including tool 110 installed therein is run into a wellbore W. Tool 110 has closure 112, ports 111 and pressure isolator 141, as described above with respect to FIG. 9. In this embodiment, tool 110 further includes downhole equipment 340, which comprises a housing or casing 345 and an electronic circuit module 344. The downhole equipment 340 is integrated or installed with tool 110. For example, tool 110 is configured with a compartment or housing component suitably sized or dimensioned to receive the electronic circuit module 344.

The receiver electronic circuit module 344 comprises a decoder/discriminator circuit 350, an activation circuit 352, an activator or actuator 354 and a power source 356. The power source 356 is configured to supply the circuits and may be implemented as a low power DC power source comprising one or more batteries. The decoder/discriminator circuit 350 includes a pressure sensor and is configured to decode, and/or recognize, output signals from the pressure sensor and generate an activation output signal for the activation circuit 352 if it receives a certain predetermined signal from the pressure sensor. The pressure sensor is configured to monitor the pressure inside the tubing string to check if the tubing pressure is at a predetermined pressure. If the tubing pressure is at the predetermined pressure, the pressure sensor sends a signal to the decoder 350, which in turn sends a signal to the activation circuit 352. The signal generated by the pressure sensor may have a signature based on frequency, polarity, pulse width, pulse number, number of pulses, etc., and the particular implementation details will be within the understanding of one skilled in art.

The activation circuit 352 is configured to be responsive to an output from the decoder circuit 350. According to an embodiment, the activation circuit 352 comprises a current source which is responsive to the output signal from the decoder 350. The current source may be implemented using discrete components, e.g. transistors, or integrate components, as will be within the understanding of one skilled in the art. According to an exemplary implementation, pressure isolator 141 is held in an activated position by a retention member comprising a heat-destructible string, such as a Kevlar string or the like. The activator 354 comprises a wire or strip that is coupled to the output of the current source, and in response to activation of the current source, the wire is heated by the current to a temperature and/or duration sufficient to melt or burn a section of the retention member, thereby releasing and inactivating pressure isolator 141. In one embodiment, downhole equipment 340 further includes a timer to selectively delay the emission of the output signal from the pressure sensor, the emission of the activation output signal from the decoder 350, and/or the response of the activation circuit 352 after receiving a signal from decoder 350.

In operation, according to an exemplary implementation and with reference to FIG. 11, downhole equipment 340 is installed on the tubing string and the tubing string is run in the wellbore W. Adjacent or in the vicinity of downhole equipment 340, tool 110 is installed and operatively coupled to downhole equipment 340. To trigger the inactivation of the pressure isolator 141, pressure is increased inside the tubing string. The pressure sensor is configured to check for a predetermined level of tubing pressure. When the pressure sensor senses that tubing pressure has reached the predetermined level, it generates an output signal which is then processed, e.g. decoded, by the electronic circuit module 344 and trigger output is generated and operatively coupled to tool 110 to inactivate pressure isolator 141. In one embodiment, the trigger output causes the electronic circuit module 344 to heat up a heating element to a temperature sufficient to destroy the retention member to release the pressure isolator, thereby inactivating it. Once the pressure isolator is inactivated, the closure 112 is exposed to tubing pressure and ports 111 can be opened as described above.

According to another mode of operation, when the pressure sensor senses that the tubing pressure is at a predetermined level, the signal emitted thereby is received by the decoder 350 and a time delay is initiated. The time delay is sufficient to allow the cement to set and for pressure tests to be conducted. In one embodiment, the time delay is one or more weeks. When the time delay expires, pressure isolator 141 is inactivated.

Figure 13:
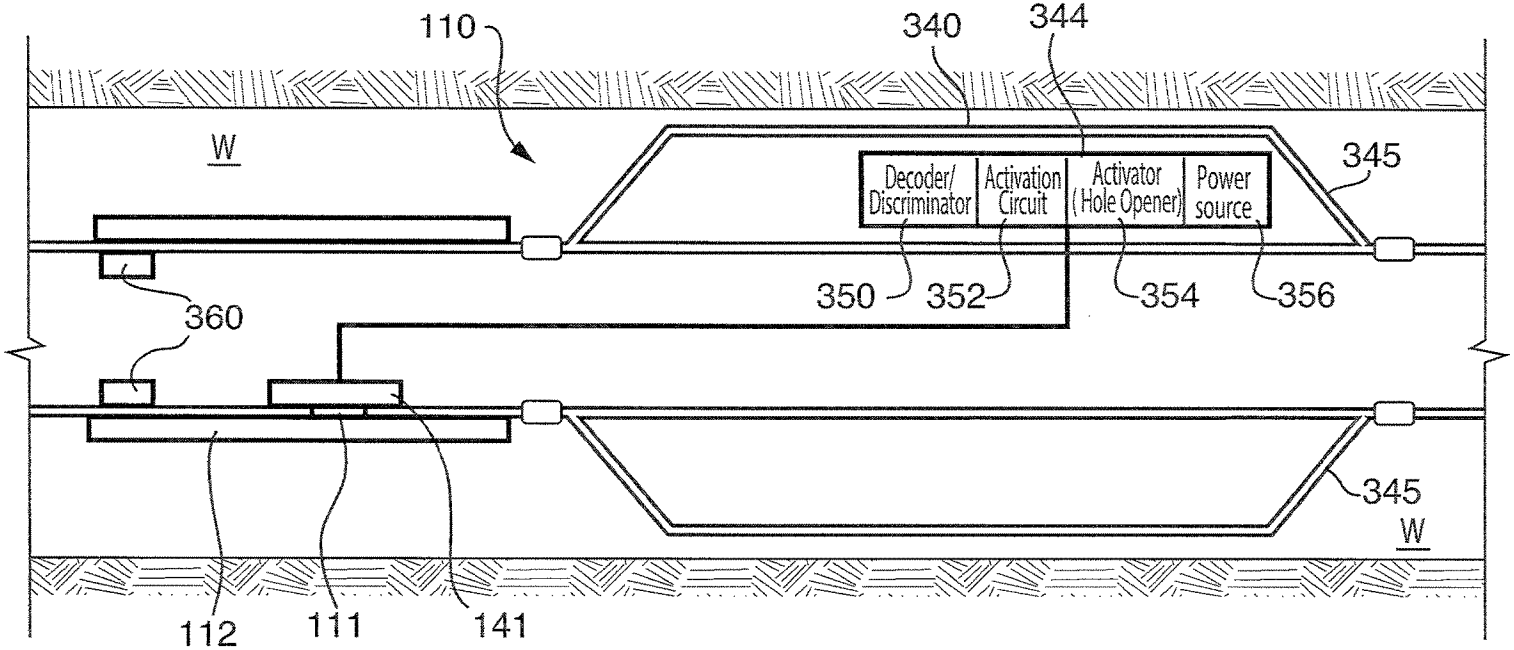
FIG. 13 is a schematic of downhole equipment according to still another embodiment of the present invention.

In a sample embodiment, with reference to FIG. 13, a string including tool 110 installed therein is run into a wellbore W. Tool 110 has closure 112, ports 111, pressure isolator 141, as described above with respect to FIG. 9. Tool 110 further comprises downhole equipment 340 having a casing 345 and an electronic circuit module 344, the latter comprising a decoder/discriminator circuit 350, an activation circuit 352, an activator or actuator 354 and a power source 356.

In this embodiment, tool 110 has one or more pressure sensors 360 for measuring internal tubing pressure. The signal generated by the pressure sensor 360 may have a signature based on frequency, polarity, pulse width, pulse number, number of pulses, etc., and the particular implementation details will be within the understanding of one skilled in art. Pressure sensor 360 is in wired or wireless communication with decoder/discriminator circuit 350, which is configured to decode and/or recognize output signals from the pressure sensor. Decoder/discriminator circuit 350 includes a microprocessor.

In one embodiment, the sensor 360 is embedded in the wall of the tool 110. Preferably, more than one pressure sensor is included in the tool to provide redundancy, i.e. in case a sensor is dislodged or is clogged up with sediment or other debris, thus failing to provide (accurate) signals. In a sample embodiment, as shown in FIG. 13, a pair of pressure sensors 360 are disposed at approximately the same axial location of the tool and are spaced about 180° apart radially from one another. Of course, other orientations and/or spacing of the sensors are possible, and also the number of sensors included in the tool may vary.

The microprocessor in decoder 350 is configured to monitor the output signal from sensor 360, and is programmable to identify certain data patterns generated by the output from the sensors. The microprocessor may be programmed to cause the circuit 350 to generate a trigger output for the activation circuit 352 when it sees a certain data pattern from the pressure sensors 360. The microprocessor may be pre-programmed before run-in and/or programmed from surface after run-in. In a further embodiment, the microprocessor may be re-programmed from surface after run-in. The software and user interface usable for programming the microprocessor and the corresponding implementation details will be within the understanding of one skilled in the art.

The activation circuit 352, activator or actuator 354 and power source 356 are all as described with respect to FIG. 11.

In one embodiment, downhole equipment 340 further includes a timer to selectively delay the emission of the activation output signal from decoder 350, and/or the response of the activation circuit 352 after receiving a signal from decoder 350.

In one embodiment, the microprocessor is programmable, for example from user-input data, to do one or more of the following:

- To have a blackout period in which the decoder 350 does not react to any pressure signals from pressure sensors 360. This function may be useful during the running-in and installation of the tool. For example, the blackout period may range from 2 to 12 hours.
- To have an averaging window for defining a baseline for hydrostatic pressure after installation of the tool, which is usually based on the rolling average of pressure measurements generated from the sensors 360 over a period of time. For example, the averaging window may range from about 8 to about 36 hours for pressures between about 1,500 and about 8,000 psi.
- To detect a predetermined test pressure that is higher than the baseline hydrostatic pressure. For example, the test pressure may be between about 2,500 and about 10,000 psi.
- To have a predetermined test duration, i.e. a specific time period for which the test pressure is maintained in the tool. For example, the test duration may range from 5 minutes to 2 hours.
- To set a delay/countdown timer for the activation circuit 352 to inactivate pressure isolator 141. The delay in inactivating the pressure isolator allows the bleeding down of the tubing pressure and may also allow further pressure testing to be done in the interim. For example, the delay period may range from about 1 minute to about 45 minutes.
- To recognize and react to certain patterns in pressure signals.

In operation, according to an exemplary implementation and with reference to FIGS. 7, 8*a* and 8*b*, downhole equipment 340 is installed on the tubing string and the tubing string is run in the wellbore W. Adjacent or in the vicinity of downhole equipment 340, tool 110 is installed and operatively coupled to downhole equipment 340. Prior to the running in of downhole equipment 340, the microprocessor of decoder 350 of tool 110 is programmed with preselected parameters (i.e. blackout period, averaging window, test pressure, test duration, delay timer, etc.). For example, the parameters may be manually inputted by a field operator via a graphical user interface of the software that is used to program the microprocessor.

Figure 14A:
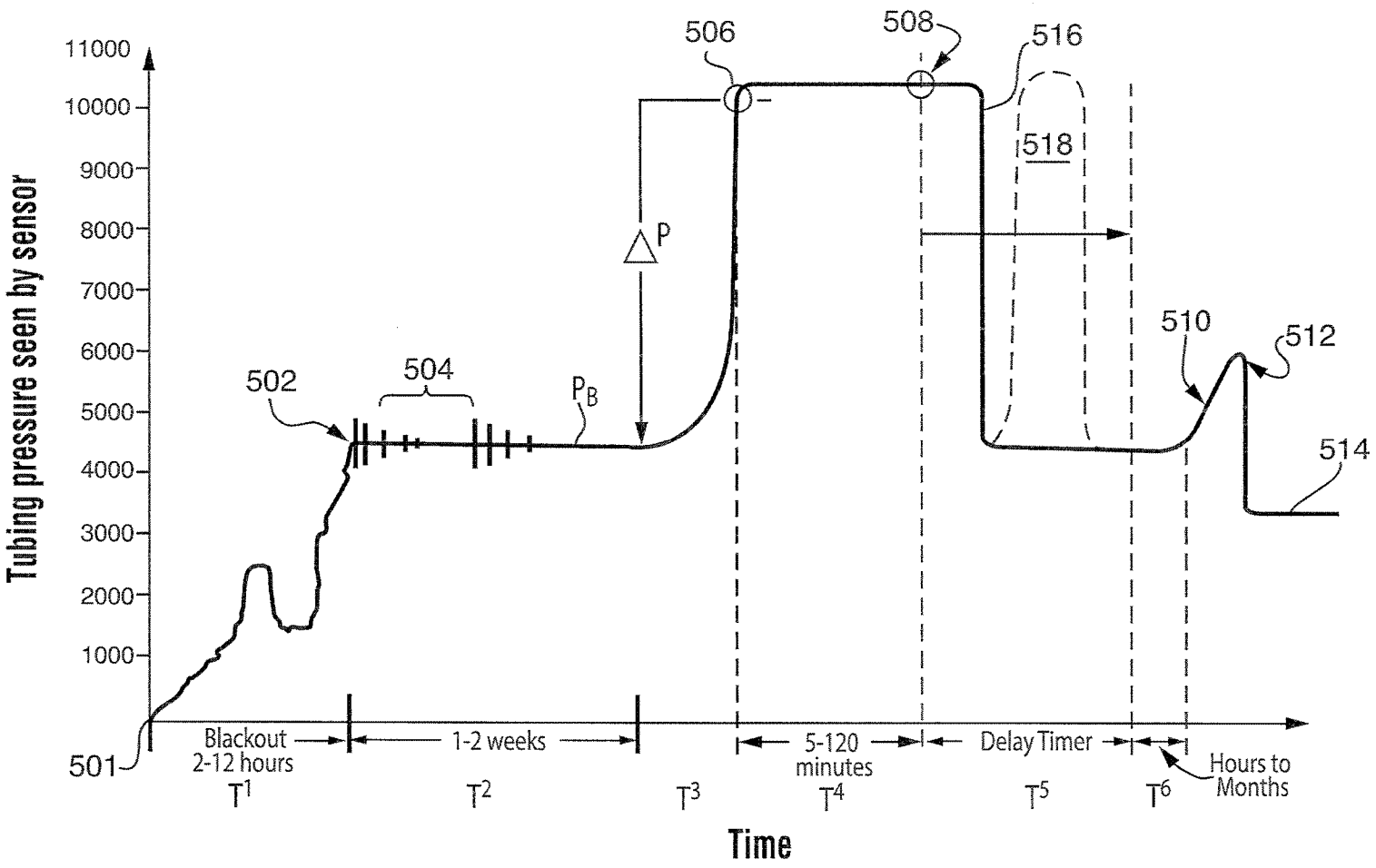
FIG. 14*a* is a graph of sample tubing pressure data from one embodiment of operation of the present invention.

In an exemplary embodiment, FIG. 14*a* shows sample tubing pressure measurements throughout the operation of the tool, including the blackout period, the averaging window, pressure testing, and post-testing operations (i.e. timer delay and opening of ports 111).

The blackout period starts immediately before or when the tool is lowered into the ground (501). During the blackout period $T^1$, the pressure sensors 360 sense tubing pressure and generate signals to the decoder 350 but the decoder is configured to not react to any signals from the sensors. The time span for the blackout period is programmed into the microprocessor and is selected to sufficiently cover the time required for running-in and installation of the downhole equipment at the desired depth.

After the blackout period, during which the downhole equipment is installed at the desired depth (502), the microprocessor takes a rolling average (504) of the tubing pressure values generated from the pressure sensor signals over the preselected averaging window programmed into the microprocessor. The rolling average provides a baseline $P_B$ for hydrostatic pressure in the tubing string. In one embodiment, the microprocessor takes a rolling average of the tubing pressure over an averaging window $T^2$ of between about 8 and about 36 hours.

After calculating the baseline pressure $P_B$, pressure testing of the tool can be initiated by pumping fluid down the tubing string from surface. In one embodiment, a pump truck is connected to the wellhead at surface to supply the fluid. The pump truck may for example be a tandem axle dump truck-sized vehicle with a 500 gallon tank and a three cylinder (triplex) pump connected to the main engine power take off. In one embodiment, the truck can apply fluid pressures as high as 15,000 psi.

The time it takes to increase the tubing pressure by a minimum test pressure $\Delta P$ from the baseline $P_B$ is denoted by $T^3$. The minimum test pressure is predetermined and is programmed into the microprocessor. When the tubing pressure reaches the test pressure (506), the microprocessor begins timing and keeps track of the elapsed time as long as the tubing pressure is at or above the test pressure. When the elapsed time reaches the predetermined test duration $T^4$, which is programmed into the microprocessor, the microprocessor determines that the testing criteria have been met (508) and in turn causes the decoder to send a trigger output to the activation circuit to initiate the inactivation of the pressure isolator.

In one embodiment, the trigger output causes the electronic circuit module 344 to heat up a heating element to a temperature sufficient to destroy the retention member to release the pressure isolator, thereby inactivating it. The time span between the initiation of the inactivation of the pressure isolator and the completion of the inactivation is denoted by $T^6$ in FIG. 14*a*. Time period $T^6$ may range from minutes to months. During time period $T^6$, the tubing pressure can be bled down so that the tubing pressure may return to about the baseline pressure $P_B$. Once the pressure isolator is inactivated, the closure 112 is exposed to tubing pressure.

When desired to open ports 111, the pressure may be raised in the tubing string and ID (510), such that a pressure differential is established across the closure that is sufficient to overcome it and open ports 111. This can be done any time after the pressure isolator is inactivated (i.e. after $T^6$). Once the ports are opened (512), the tubing pressure and annulus pressure are equalized (514).

According to another mode of operation, when the microprocessor determines that the test criteria have been met (508), a time delay $T^5$ for initiating the inactivation of the pressure isolator is initiated. The time delay $T^5$ allows the tubing pressure to be bled down (516) before inactivating the pressure isolator and may also allow further pressure testing to be done during the time delay (518).

Figure 14B:
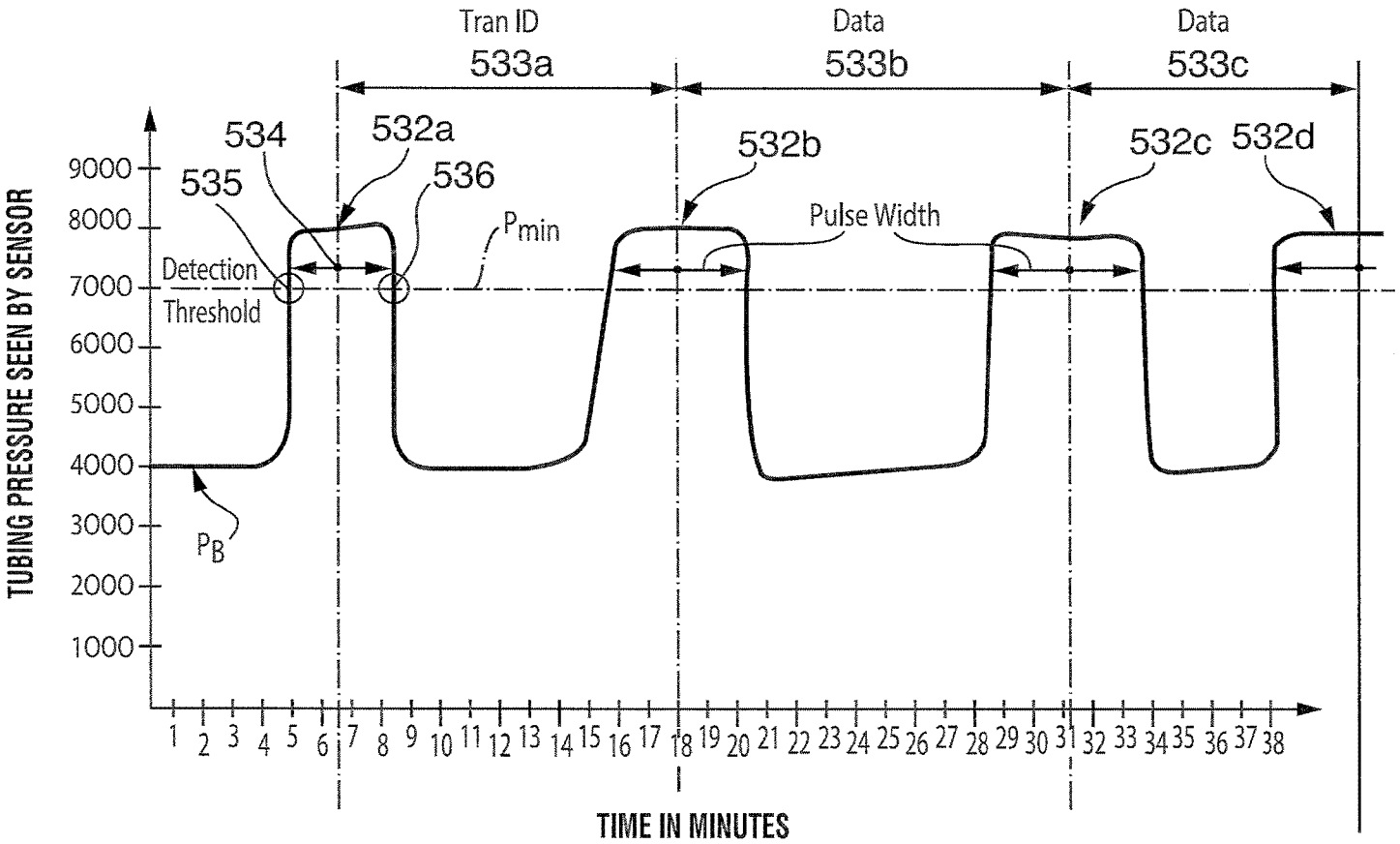
FIG. 14*b* is a graph of sample tubing pressure data from another embodiment of operation of the present invention.

In a further embodiment, low-speed pressure pulses may be used to encode data via a time-based algorithm in order to communicate with and send commands to tool 110. This may provide an option for controlling the tool after the tool has been installed in the ground. In an exemplary embodiment, FIG. 14*b* shows sample tubing pressure data generated by pumping bursts of fluid down the tubing string at various time intervals, as detected by sensors 360. When a burst of fluid reaches the tool, the pressure sensors detect an increase in tubing pressure, relative to the baseline hydrostatic pressure $P_B$. When the fluid in the tubing string is bled-off after each burst, the pressure sensors detect a drop in tubing pressure. In between bursts, the tubing pressure as detected by the pressure sensors is the baseline hydrostatic pressure. The rise and fall of tubing pressure forms a pressure pulse 532.

In this embodiment, before the tool is deployed downhole, the microprocessor of the decoder 350 is preprogrammed with a detection threshold value $P_{min}$ and a number of pulse interval values, each being associated with a different command. The detection threshold value is the minimum tubing pressure that the pressure sensors have to detect in order for the microprocessor to recognize that the pressure data is part of a pressure pulse 532. The pulse interval value is determined from the time span between two consecutive pressure pulses.

In order to determine the time span between two consecutive pressure pulses, the microprocessor determines the center of each pressure pulse by calculating the midpoint 534 between the rise 535 of the pulse (i.e. the point in time at which the rise in pressure exceeds the threshold $P_{min}$) and the fall 536 of the pulse (i.e. the point in time at which the decrease in pressure falls below the threshold $P_{min}$). The time span between two consecutive pressure pulses is the difference between the time of the midpoint of the first pulse and that of the second pulse.

In one embodiment, the time span 533*a* between the first two pressure pulses 532*a*, 532*b*, (referred to herein as "train ID") determines the type of command contained in the subsequent pulses 532*c*, 532*d*, etc. Once the train ID 533*a* is determined, the microprocessor correlates the train ID 533*a* with a pulse interval value that is preprogrammed therein, to determine the type of command that is associated with the subsequent pulses. More specifically, the length of the train ID determines the type of command for the tool. The types of command may include for example: 1) test complete; 2) adjust pressure; 3) adjust mode; and 4) adjust timer. Further, as an example, a train ID that is 10 min in length is associated with one command (e.g. "test complete") and a train ID that is 15 min is associated with another command (e.g. "adjust timer"). Preferably, train IDs are longer in length than the time span between other consecutive pressure pulses in order for the microprocessor to differentiate train ID pulses from other pressure pulses.

The pressure pulses (e.g. 532*c*, 532*d*) that follow the train ID pulses (referred to herein as "command pulses") contain the command details for the type of command as determined from the train ID. The command pulses provide the necessary information to the microprocessor to control the tool. In one embodiment, the command data is harvested from the timing between pulses. For example, the train ID indicates the command for "adjust pressure" and the timing between consecutive command pulses indicate the digits of the new pressure value. For instance, the second pulse of the train ID and three subsequent command pulses are about 5 minutes apart between consecutive pulses, which indicates to the tool to adjust the pressure threshold to 5550 psi. In another example, if the second pulse of the train ID and three subsequent command pulses are about 4 seconds, 5 seconds, and 5 seconds apart, respectively, between consecutive pulses, the tool adjusts the pressure threshold to 4550 psi.

In one embodiment, for simple commands or low-resolution data (i.e. yes/no type commands such as "test complete"), two or three command pulses may be sufficient to communicate the command details to the microprocessor. For more complex or high-resolution data (i.e. commands relating to small incremental changes, such as pressure adjustments of about 10 psi increments, timer adjustments of about 5 minute increments, etc.), three to six command pulses may be necessary.

It is preferable that the fluid source (e.g. pump truck) can provide a high pressure-up rate and that the tubing pressure can be bled-off quickly through the surface valving. Faster rise and fall times of the pressure pulses are preferred over slower ones.

In another embodiment where the pressure isolator can be inactivated without the use of a dart, a sending unit, or the like, strain gauges are installed on the outer diameter of the tubing string and are programmed to sense an increase in the diameter of the tubing string. The tubing string includes a tool having a pressure isolator that, when activated, isolates a closure from tubing pressure. To trigger the inactivation of the pressure isolator, pressure is increased inside the tubing string. When the pressure increases to a certain level, the tubing string slightly expands in diameter and the strain gauges can detect the expansion of the tubing string. When the strain gauges detect an expansion of tubing string, a signal is sent to the electronic components in the tool to inactivate the pressure isolator. In one embodiment, a signal pattern is preprogrammed into the electronic components such that the inactivation of the pressure isolator cannot be triggered unless the signal generated by the strain gauges corresponds to the preprogrammed signal pattern. The inactivation of the pressure isolator may optionally be selectively delayed from when an expansion of the tubing string is detected. Once the pressure isolator is inactivated, the closure is exposed to tubing pressure, allowing ports in the tool to be opened as described above.

Figure 12:
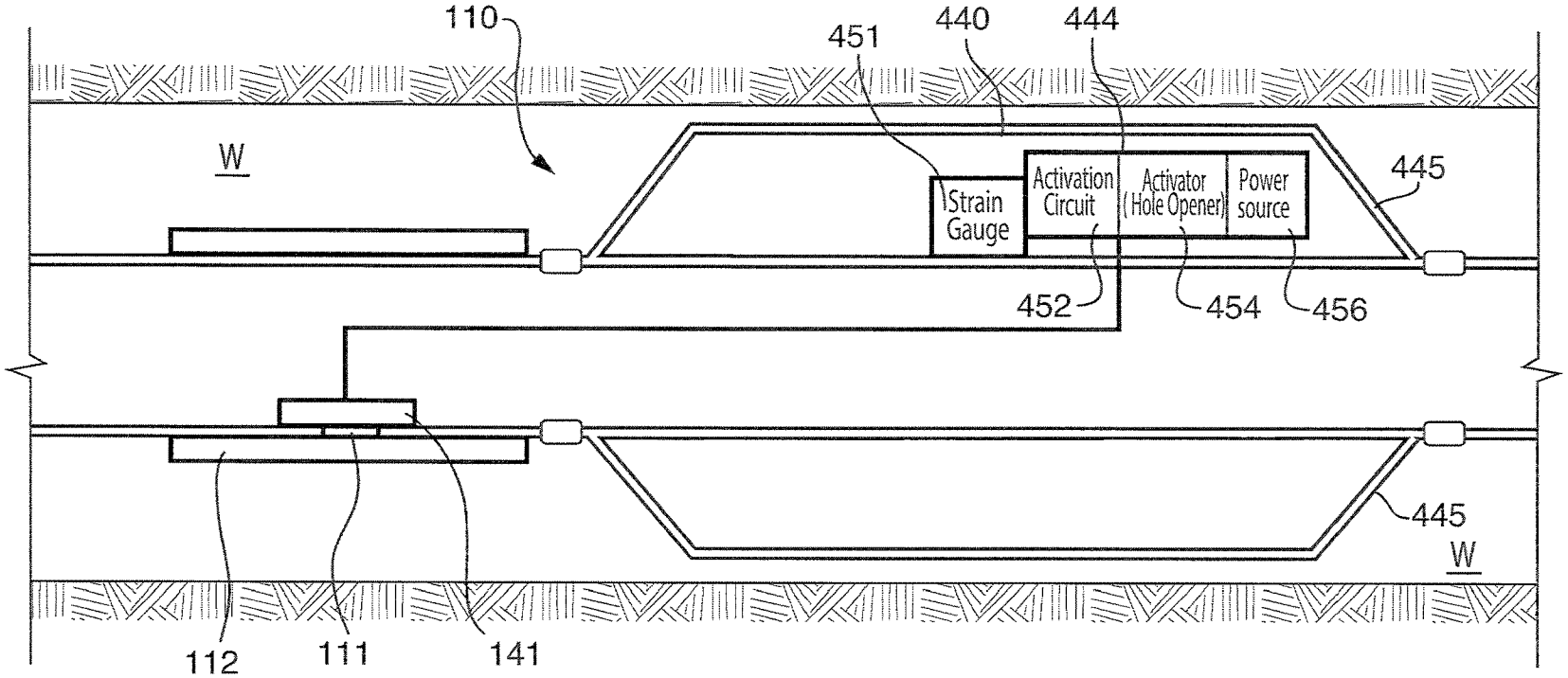
FIG. 12 is a schematic of a downhole equipment according to yet another embodiment of the present invention.

With reference to FIG. 12, in an exemplary embodiment, a string including tool 110 installed therein is run into a wellbore W. Tool 110 has closure 112, ports 111 and pressure isolator 141, as described above with respect to FIG. 9. In this embodiment, tool 110 further includes downhole equipment 440, which comprises a housing or casing 445 and an electronic circuit module 444. The downhole equipment 440 is integrated or installed with tool 110. For example, tool 110 is configured with a compartment or housing component suitably sized or dimensioned to receive the electronic circuit module 444.

The receiver electronic circuit module 444 comprises a strain gauge 451, an activation circuit 452, an activator or actuator 454 and a power source 456. The power source 456 is configured to supply the circuits and may be implemented as a low power DC power source comprising one or more batteries.

In one implementation, strain gauge 451 is installed on the outer diameter of the tubing string. Strain gauge 451 is configured to detect changes in the outer diameter of the tubing string and generate an activation output signal for the activation circuit 452 if it detects a predetermined amount of increase in the tubing string outer diameter. It can be appreciated that the tubing string can be tested prior to running in to determine the amount of tubing string expansion that is substantially equivalent to a certain increase in tubing pressure. The amount by which the tubing string expands is mainly determined by the magnitude of the increase in tubing pressure and the material of the tubing string. If strain gauge detects that the tubing string has expanded by a predetermined amount, the strain gauge sends a signal to the activation circuit 452. The signal generated by the strain gauge may have a signature based on frequency, polarity, pulse width, pulse number, number of pulses, etc., and the particular implementation details will be within the understanding of one skilled in art.

The activation circuit 452 is configured to be responsive to an output from strain gauge 451. In one embodiment, the strain gauge 451 outputs a signal having a predetermine pattern when it detects that the tubing string has expanded by the predetermined amount and the activation circuit 452 is preprogrammed to recognize only that signal pattern such that the activation circuit does not communicate with other electronic components unless the received signal pattern matches the preprogrammed pattern. According to an embodiment, the activation circuit 452 comprises a current source which is responsive to the output signal from the strain gauge 451. The current source may be implemented using discrete components, e.g. transistors, or integrate components, as will be within the understanding of one skilled in the art. According to an exemplary implementation, pressure isolator 141 is held in an activated position by a retention member comprising a heat-destructible string, such as a Kevlar string or the like. The activator 454 comprises a nichrome wire or strip that is coupled to the output of the current source, and in response to activation of the current source, the nichrome wire is heated by the current to a temperature and/or duration sufficient to melt or burn a section of the retention member, thereby releasing and inactivating pressure isolator 141. In one embodiment, downhole equipment 440 further includes a timer to selectively delay the emission of the output signal from the strain gauge 451 and/or the response of the activation circuit 452 after receiving a signal from strain gauge 451.

In operation, according to an exemplary implementation and with reference to FIG. 12, downhole equipment 440 is installed on the tubing string, with strain gauge 451 installed on the outer diameter of the tubing string, and the tubing string is run in the wellbore W. Adjacent or in the vicinity of downhole equipment 440, tool 110 is installed and operatively coupled to downhole equipment 440. To trigger the inactivation of the pressure isolator 141, pressure is increased inside the tubing string. The strain gauge is configured to detect a predetermined amount of increase in the outer diameter of the tubing string. When the strain gauge detects that tubing string has expanded by the predetermine amount, it generates an output signal which is then processed, e.g. decoded, by the electronic circuit module 444 and trigger output is generated and operatively coupled to tool 110 to inactivate pressure isolator 141. In one embodiment, the trigger output causes the electronic circuit module 444 to heat up a heating element to a temperature sufficient to destroy the retention member to release the pressure isolator, thereby inactivating it. Once the pressure isolator is inactivated, the closure 112 is exposed to tubing pressure and ports 111 can be opened as described above.

According to another mode of operation, when the strain gauge detects that the tubing string has expanded by the predetermined amount, the signal emitted thereby is received by activation circuit 452 and a time delay is initiated. The time delay is sufficient to allow the cement to set and for pressure tests to be conducted. In one embodiment, the time delay is one or more weeks. When the time delay expires, pressure isolator 141 is inactivated.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore tool comprising:

a tubular housing with a wall defining an inner bore and a port;

a sleeve moveable between a closed port position and an open port position;

a pressure isolator configurable between an active condition in which, the sleeve is restrained from being actuated by inner bore pressure, and an inactive condition in which the sleeve is not restrained from being actuated by inner bore pressure;

a first releasable locking member to permit actuation of the sleeve by the inner bore pressure when the pressure isolator moves into the inactive condition, and a second releasable locking member adapted to allow the sleeve to move in the open port position when the inner bore pressure exceeds a pressure rating of the second releasable locking member.

2. The wellbore tool of claim 1 further comprising downhole equipment operable to configure the pressure isolator in the inactive condition in response to the downhole equipment receiving an output signal to permit fluid to pass from the inner bore into actuable contact with the sleeve.

3. The wellbore tool of claim 2 wherein the output signal is any one of: hydraulic, electronic, radio, pressure, and electro-magnetic.

4. The wellbore tool of claim 2 wherein the downhole equipment comprises a decoder for receiving the output signal and generating an activation output signal to inactivate the pressure isolator.

5. The wellbore tool of claim 4 wherein the downhole equipment includes a delay timer for selectively providing a time delay between the receipt of the output signal and the inactivation of the pressure isolator.

6. The wellbore tool of claim 4 wherein the output signal is received from an external sending unit conveyable through the inner bore, when the sending unit comes into proximity of the downhole equipment.

7. The wellbore tool of claim 6 wherein the sending unit is an untethered dart.

8. The wellbore tool of claim 4 wherein the downhole equipment further comprises an activation circuit having a current source responsive to the output signal for supplying current to release the releasable locking member.

9. The wellbore tool of claim 4 wherein the decoder includes a microprocessor programmable to enable one or more of:

(i) providing a blackout period;

(ii) providing an averaging window for defining a baseline for hydrostatic pressure in the inner bore;

(iii) detecting a test pressure;

(iv) providing a test duration;

(v) setting a delay timer for selectively providing a time delay between the receipt of the output signal and the inactivation of the pressure isolator; and (vi) identifying patterns in the output signal from the one or more pressure sensors.

10. The wellbore tool of claim 9 wherein the microprocessor is pre-programmed with a detection threshold value and a number of pulse interval values, each being associated with a command for controlling the wellbore tool.

11. The wellbore tool of claim 10 wherein the command is one of: test complete, adjust pressure, adjust mode, and adjust timer.

12. The wellbore tool of claim 2 wherein the output signal has a signature based on one or more of frequency, polarity, pulse width, pulse number, number of pulses.

13. The wellbore tool of claim 2 wherein the downhole equipment further comprises one or more pressure sensors configured to monitor the pressure in the inner bore and to generate the output signal upon sensing a predetermined pressure in the inner bore.

14. The wellbore tool of claim 1 wherein the tool mechanism is a ported, fluid treatment tool having housing has one or more ports openable to provide fluid access between the inner bore and the outer surface when the pressure isolator is inactivated.

15. The wellbore tool of claim 14 wherein the the sleeve is provided in a chamber defined in the wall of the tubular housing, the sleeve being axially slideable between a blocking position blocking the one or more ports, and an open position at least partially retracted from the one or more ports.

16. The wellbore tool of claim 15 wherein when the pressure isolator is in the active condition, the sleeve is in the closed port position and when the pressure isolator is in the inactive condition, fluid is permitted to pass from the inner bore into the chamber, thereby moving the sleeve into the open port position.

17. The wellbore tool of claim 16 wherein the first releasable locking member is destroyed after the downhole equipment receives the output signal, thereby releasing fluid communication between the inner bore and the chamber.

18. The wellbore tool of claim 17 wherein the first releasable locking member is heat-destructible.

19. The wellbore tool of claim 1 further comprising one or more strain gauges installed on an outer diameter of a tubing string connectable to the wellbore tool for detecting a change in the outer diameter of the tubing string and in response generating the output signal.

20. A method for actuating a downhole tool, the method comprising:

conducting a pressure test in a tubing string by raising the tubing pressure to a test pressure;

preventing the test pressure from hydraulically actuating a slidable sleeve of the wellbore tool during the pressure test by operating a pressure isolator in an active condition to block a tubing fluid pressure above the actuating level of the sleeve from being communicated to the sleeve;

releasing a first releasable locking member of the pressure isolator in response to the pressure isolator moving into an inactive condition to permit actuation of the sleeve; and employing fluid pressure greater than a pressure rating of the second releasable locking member to hydraulically actuate the sleeve by releasing a second releasable locking member of the sleeve.

21. The method of claim 20 wherein the downhole tool is installed adjacent a distal end of a tubing string.

22. The method of claim 20 further comprising dropping a dart through the tubing string, the dart emitting an output signal which is detected by the downhole tool when the dart passes thereby.

23. The method of claim 22 wherein the output signal has a characteristic-predetermined signature.

24. The method of claim 23 further comprising identifying the signature of the output signal and generating an activation output signal for inactivating the pressure isolator, in response to identifying the signature of the output signal.

25. The method of claim 24 further comprising initiating a time delay after detecting the output signal for inactivating the pressure isolator.

26. The method of claim 20 further comprising monitoring the pressure inside the tubing string and generating an output signal, when the pressure is substantially the same as a predetermined pressure, for inactivating the pressure isolator.

27. The method of claim 26 further comprising initiating a time delay for inactivating the pressure isolator.

28. The method of claim 20 further comprising measuring the pressure inside the tubing string and generating an output signal indicating the pressure measured.

29. The method of claim 28 further comprising ignoring the output signal for a predetermined blackout period during the installation of the downhole tool.

30. The method of claim 29 further comprising determining a baseline hydrostatic pressure by averaging the output signal over a preselected averaging window.

31. The method of claim 30 further comprising pumping bursts of fluid down the tubing string at various time intervals to generate corresponding pressure pulses in the output signal and determining the time span between consecutive pressure pulses that are above a detection threshold value.

32. The method of claim 20 further comprising measuring changes in the outer diameter of the tubing string at various values of the test pressure and generating an output signal, if the changes meet one of a predetermined amount and a predetermined pattern, for inactivating the pressure isolator.

33. The method of claim 20 wherein the test pressure is greater than the fluid pressure employed to hydraulically actuate the downhole tool.

34. The method of claim 20 wherein inactivating the pressure isolator includes communicating the test pressure to a piston driving movement of a j-pin through a j-slot from a neutral position to a final position in which the pressure isolator is inactivated.

35. The method of claim 34 inactivating requires pressuring up at least one additional time after the pressure test to move the j-pin to the final position.

36. The method of claim 35 wherein the at least one additional time raises the tubing pressure to a pressure less than the test pressure.

37. The method of claim 35 wherein inactivating includes unlocking the first releasable locking member of the pressure isolator from the sleeve so that the sleeve can thereby response to fluid pressure.

38. The method of claim 37 wherein after inactivating, the sleeve of the downhole tool remains secured by shear pins and employing fluid pressure to hydraulically actuate the downhole tool includes shearing the shear pins.

39. The method of claim 20 wherein the downhole tool is a toe sub installed in a tubing string and the method further comprises closing a circulation valve and setting the tubing string in the well prior to conducting.

40. The method of claim 39 further comprising fluid treating a wellbore accessed through the tubing string after employing fluid pressure to hydraulically actuate the sleeve.

41. A tubing string for installation in a wellbore, the tubing string comprising:

a toe sub installed adjacent a distal end of the tubing string, the toe sub including a tubular housing with a wall defined defining an inner bore;

a port extending through the wall;

a port closure openable in response to a tubing fluid pressure of an actuating level;

a pressure isolator configurable between an active condition and an inactive condition, the pressure isolator including a first releasable locking member adapted to restrain the port closure from being actuated by the tubing fluid pressure when the pressure isolator is in the active condition and the first pressure isolator to permit actuation of the port closure by tubing fluid pressure when the pressure isolator is in the inactive condition and;

a second releasable locking member for securing the port closure in a closed position when the releasable locking member permits actuation of the port closure, the second releasable locking member configured to be overcome by a tubing pressure of the second releasable locking member.

42. The tubing string of claim 41 further comprising a circulation valve between the distal end and the toe sub.

43. The tubing string of claim 41 wherein the pressure isolator is responsive to pressure pulses to move into the inactive condition.

* * * * *